US011459002B2

(12) United States Patent
Zhang et al.

(10) Patent No.: US 11,459,002 B2
(45) Date of Patent: Oct. 4, 2022

(54) METHODS AND SYSTEMS FOR DYNAMIC WEIGHT MANAGEMENT

(71) Applicant: Transportation IP Holdings, LLC, Norwalk, CT (US)

(72) Inventors: Jingjun Zhang, Erie, PA (US); Bret D. Worden, Erie, PA (US); Ibrahim Kacar, Erie, PA (US); John Frederick, Erie, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 487 days.

(21) Appl. No.: 16/575,308

(22) Filed: Sep. 18, 2019

(65) Prior Publication Data

US 2021/0078615 A1 Mar. 18, 2021

(51) Int. Cl.
*B61F 5/38* (2006.01)
*B61F 3/06* (2006.01)

(52) U.S. Cl.
CPC ..... *B61F 5/386* (2013.01); *B61F 3/06* (2013.01)

(58) Field of Classification Search
CPC .. F16F 15/00; B61F 5/386; B61F 3/06; B61F 5/383
See application file for complete search history.

(56) References Cited

U.S. PATENT DOCUMENTS 3,046,003 A * 7/1962 Schultz ..... B60G 15/12 267/64.24
5,489,009 A * 2/1996 Kawamata ..... F16F 9/532 188/298
8,418,626 B2 * 4/2013 Gorski ..... B61F 5/36 105/182.1
9,630,469 B2 * 4/2017 Leonard ..... B60G 15/06
2016/0290505 A1 * 10/2016 Peterson ..... F15B 15/2838
2017/0305495 A1 * 10/2017 Schwindt ..... F16F 9/20
2018/0079274 A1 * 3/2018 Rose ..... B60G 17/0521

FOREIGN PATENT DOCUMENTS

CN 206030988 U * 3/2017
CN 108361308 A * 8/2018 ..... F16F 9/06
DE 102017124649 A1 * 5/2018 ..... B60G 11/27
EP 0317554 B1 * 3/1993
EP 2956317 B1 * 6/2018 ..... B60G 15/062
JP 2016500145 A * 7/2016

OTHER PUBLICATIONS

English translation of EP 0317554 (Year: 1993).*

* cited by examiner

*Primary Examiner* — Robert A. Siconolfi
*Assistant Examiner* — Mahbubur Rashid
(74) *Attorney, Agent, or Firm* — McCoy Russell LLP

(57) ABSTRACT

Systems and methods for reducing slack in a linkage chain of a vehicle truck assembly is provided. In one example, a method includes compressing a vehicle suspension by actuating an actuator with a cylinder abutted to a piston rod, the piston rod coupled to the vehicle suspension and, when deactivating the actuator, maintaining at least nominal compression on the vehicle suspension with the piston rod spaced away from a piston of the cylinder via a biasing member, the piston configured to slide within the cylinder along a central axis of the cylinder.

18 Claims, 11 Drawing Sheets

METHODS AND SYSTEMS FOR DYNAMIC WEIGHT MANAGEMENT

BACKGROUND

Technical Field

The subject matter disclosed herein relates to an actuation system coupled to a truck assembly in a vehicle.

Discussion of Art

Vehicles may be configured with truck (bogie) assemblies including two trucks per assembly and multiple axles per truck. Trucks with multiple axles may include at least one powered axle and at least one non-powered axle. The axles may be mounted to the truck via lift mechanisms (e.g., pneumatic actuators) for adjusting a distribution of vehicle weight (including a vehicle body weight and a vehicle truck weight) between the axles. Weight distribution among the powered and non-powered axles may be performed statically and/or dynamically by adjusting a mechanism that provides dynamic weight management (DWM).

The DWM mechanism may include an actuatable linkage arrangement with a lever coupled to a carrier by a lifting chain, the carrier supporting a non-powered axle. The linkage between the lever and carrier, as provided by the lifting chain, may enable dynamic re-distribution of a load to other axles, e.g., the at least one powered axle, by implementing lift via a lift mechanism. A weight on the non-powered axle is thereby reduced in response to vehicle operating conditions, increasing the weight on powered axles and a tractive force from the vehicle on a receiving structure, such as a rail. The lift mechanism may also decrease lift, transferring a portion of the load to the non-powered axle in response to an event such as vehicle braking.

Over time, components of the DWM mechanism may degrade. For example, the lifting chain may come into contact with the truck frame and abrade the truck frame surface. Variations in chain tension between fully taut and slack may lead to links of the lifting chain compressing and moving forcibly against one another, resulting in weakening and/or bending of the links. As a result, maintenance and replacement of DWM components may occur more frequently. It may be desirable to have a system and method that differs from those that are currently available.

BRIEF DESCRIPTION

Systems and methods for a lift mechanism for a vehicle truck assembly having a plurality of chains linking lever arms to carriers of the truck assembly are provided. The method may include compressing a vehicle suspension by actuating an actuator with a cylinder abutted to a piston rod, the piston rod coupled to the vehicle suspension, and when deactivating the actuator, maintaining at least nominal compression on the vehicle suspension with the piston rod spaced away from a piston of the cylinder via a biasing member, the piston configured to slide within the cylinder along a central axis of the cylinder.

In one embodiment, a method for dynamic weight transfer of a vehicle axle may include compressing a vehicle suspension by actuating an actuator with a cylinder abutted to a piston rod, the piston rod coupled to the vehicle suspension, and, when deactivating the actuator, maintaining at least nominal compression on the vehicle suspension with the piston rod spaced away from a piston of the cylinder via a biasing member, the piston configured to slide within the cylinder along a central axis of the cylinder.

In another embodiment, a weight transfer system for a vehicle may include a vehicle suspension coupled to an axle of the vehicle, a pneumatic actuator having a cylinder piston abutted to a piston rod and configured to adjust the vehicle suspension based on a pressure in the pneumatic actuator, the piston rod coupled to the vehicle suspension through a linkage arrangement, and a spring member arranged in the cylinder and configured to exert a force on the piston rod along a central axis of the cylinder in a direction opposing a sliding of the piston rod when the vehicle suspension is decompressed.

In yet another embodiment, a dynamic weight management (DWM) system may include a lift mechanism including a crank coupled to a chain, the chain extending between a truck and a carrier of the lift mechanism, a pneumatic actuator configured to adjust the lift mechanism by rotating the crank, the pneumatic actuator including a piston coupled to a piston tube, both the piston and the piston tube enclosed by an outer housing of the pneumatic actuator, a rod extending along a central axis of the pneumatic actuator, a first portion of the rod enclosed by the piston tube and a second portion of the rod protruding from the piston tube and coupled to the crank, and a spring enclosed by the piston tube and coiling around the rod, the spring extending between a first end abutting a first spring seat fixedly attached to the rod and a second end abutting a second spring seat fixedly attached to the piston tube. In this way, degradation to components of the vehicle truck assembly may be reduced, thereby increasing component life and reducing maintenance and repair events.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 3:
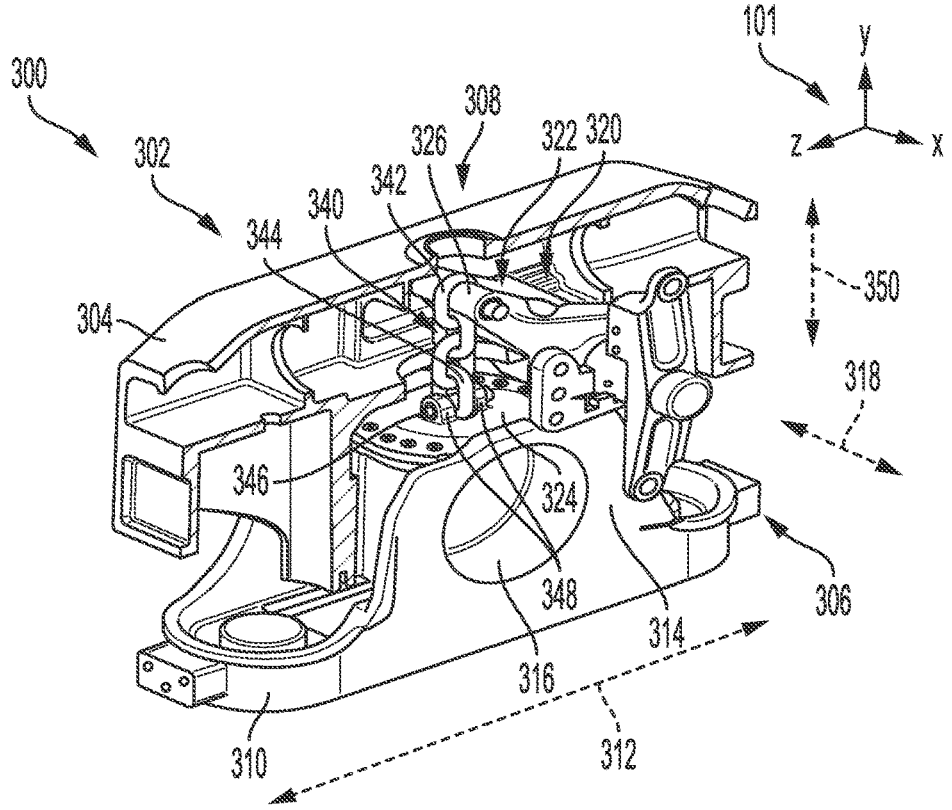
FIG. 3 shows a perspective view of a section of the truck including an example linkage arrangement that may be coupled to a lift mechanism.
Figure 4:
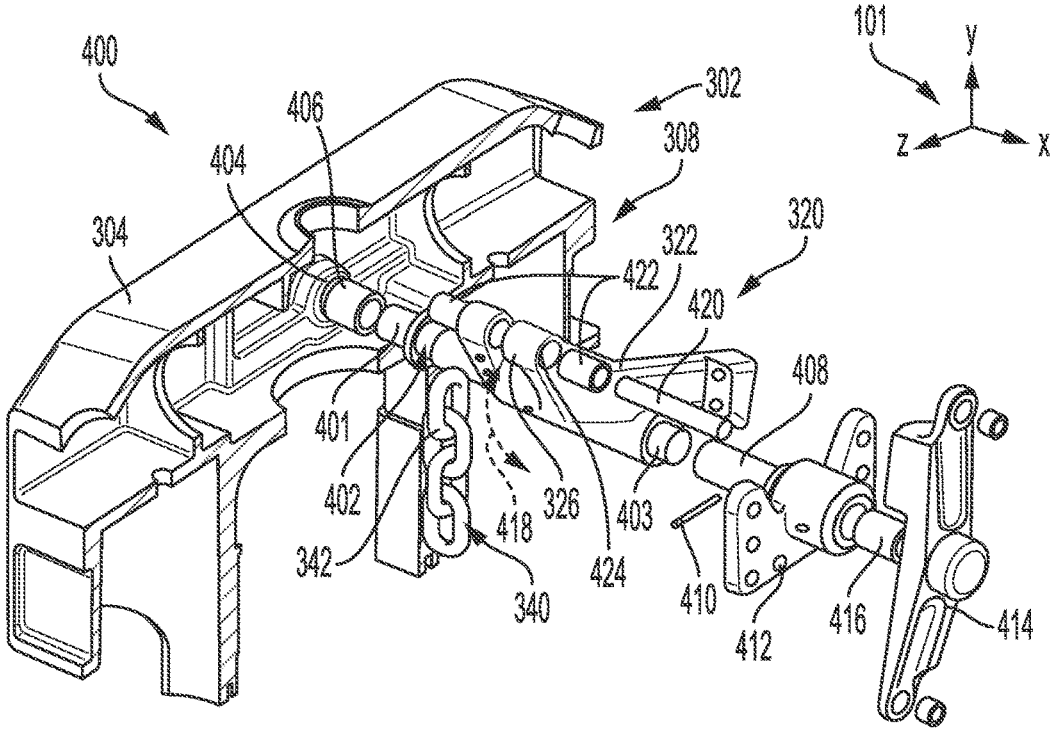
FIG. 4 shows an exploded view of the linkage arrangement of FIG. 3.
Figure 5:
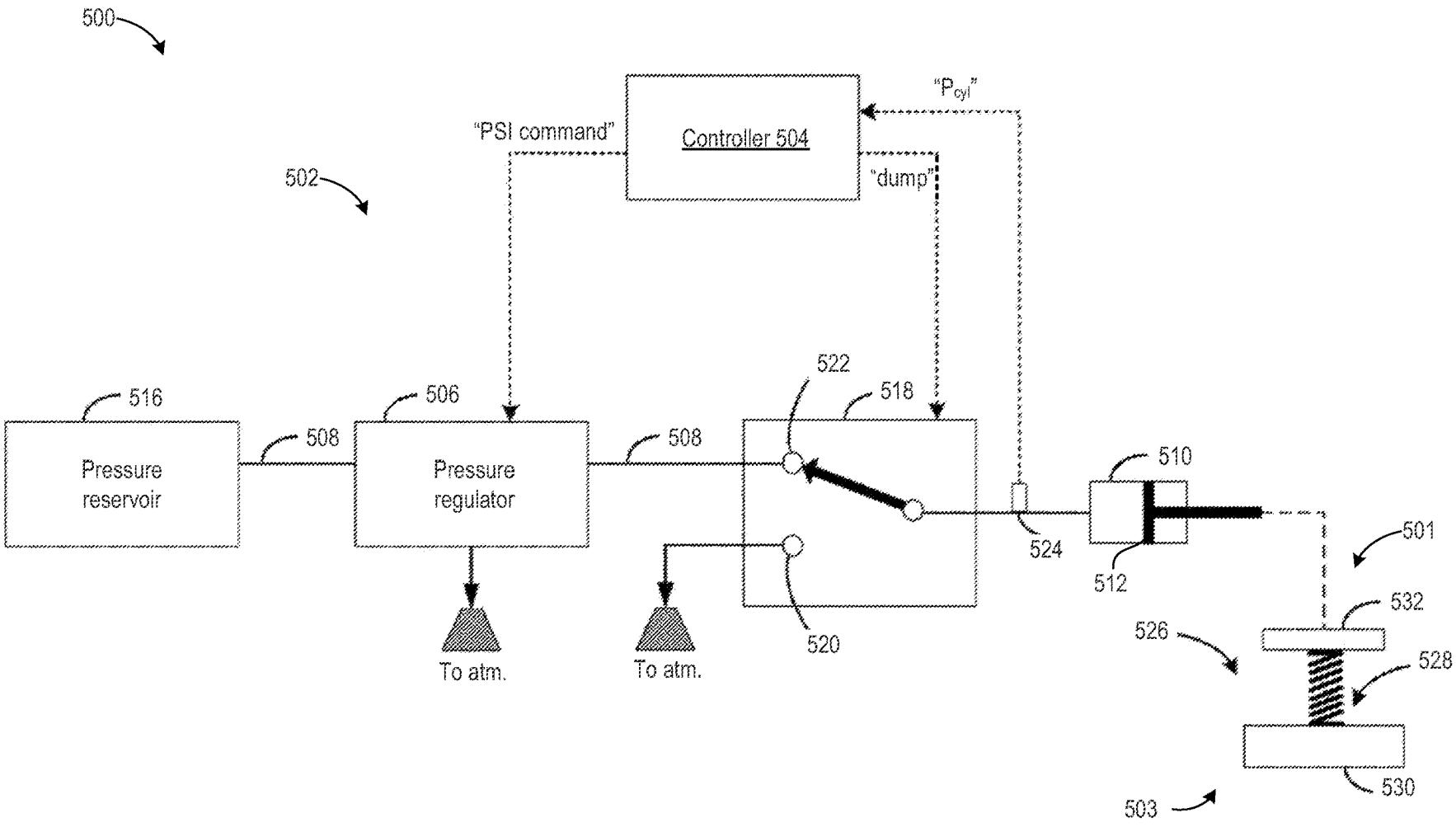
FIG. 5 shows an example schematic diagram of a pneumatic actuation system of a lift mechanism.
Figure 6:
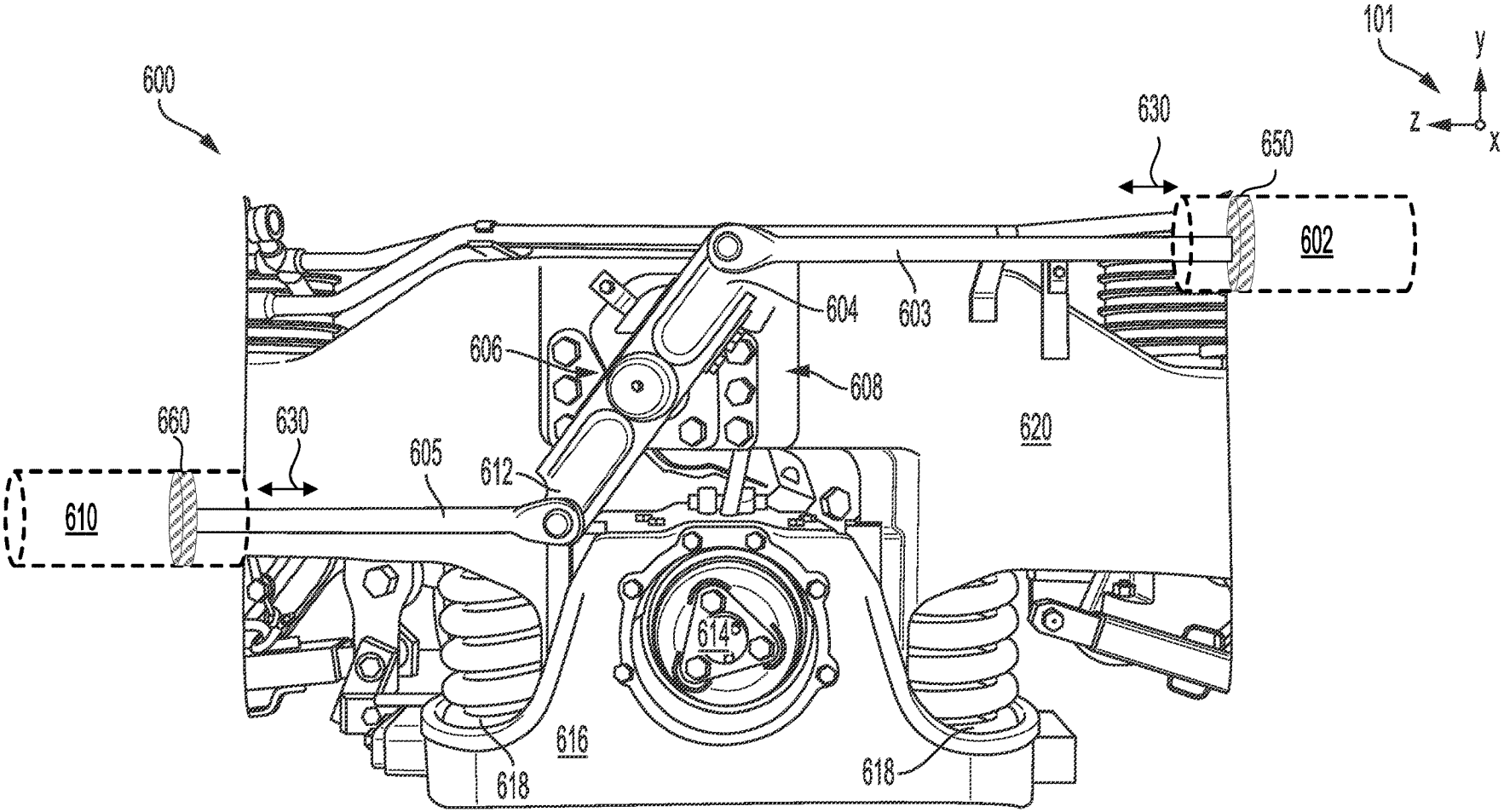
FIG. 6 shows an example of a linkage arrangement coupled to a lift mechanism and a pneumatic actuation system of a lift mechanism.
Figure 7:
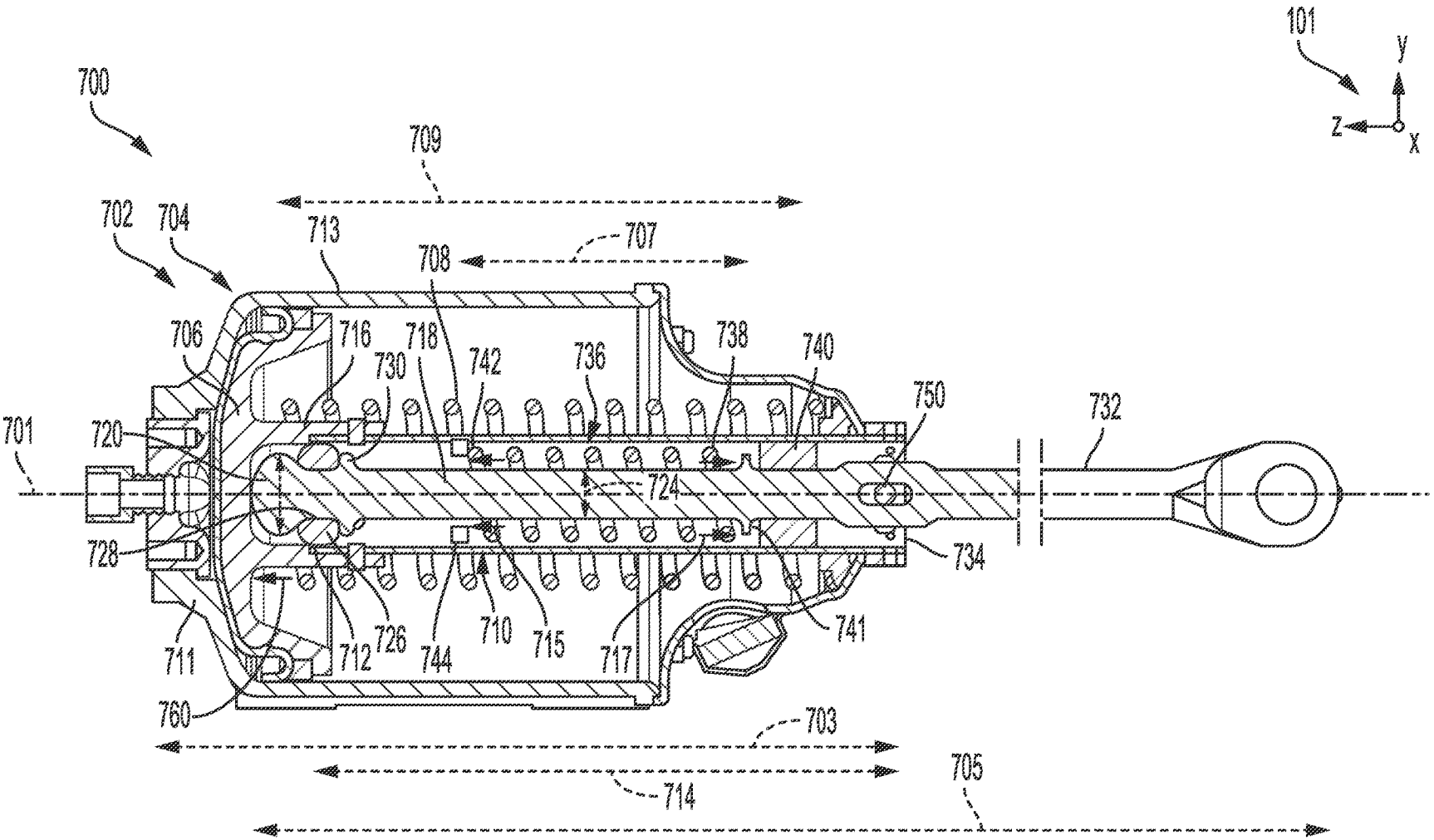
FIG. 7 shows an example of a pneumatic actuator equipped with a retention spring in a first position.
Figure 8:
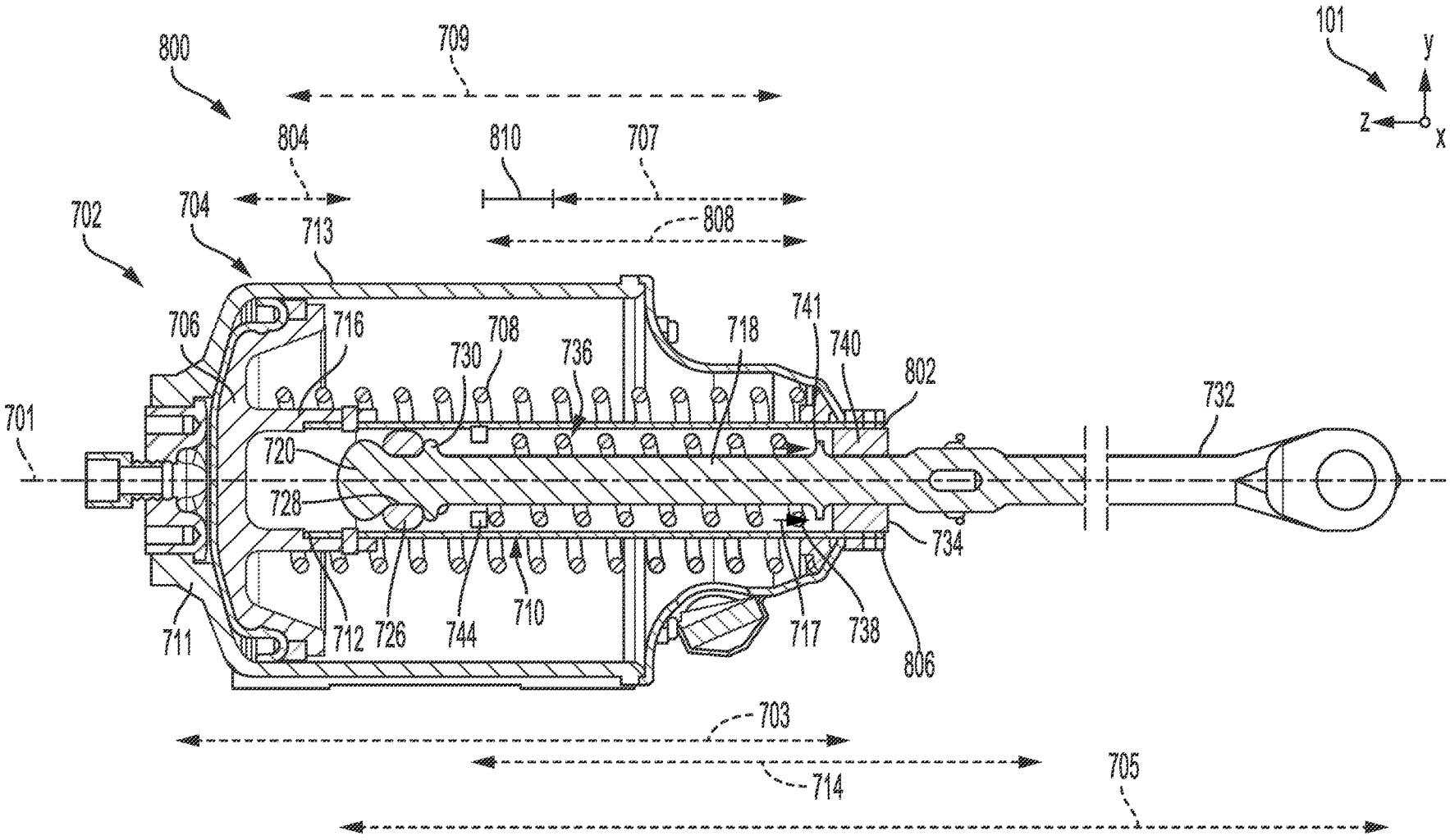
FIG. 8 shows an example of the pneumatic actuator equipped with the retention spring in a second position.
Figure 9:
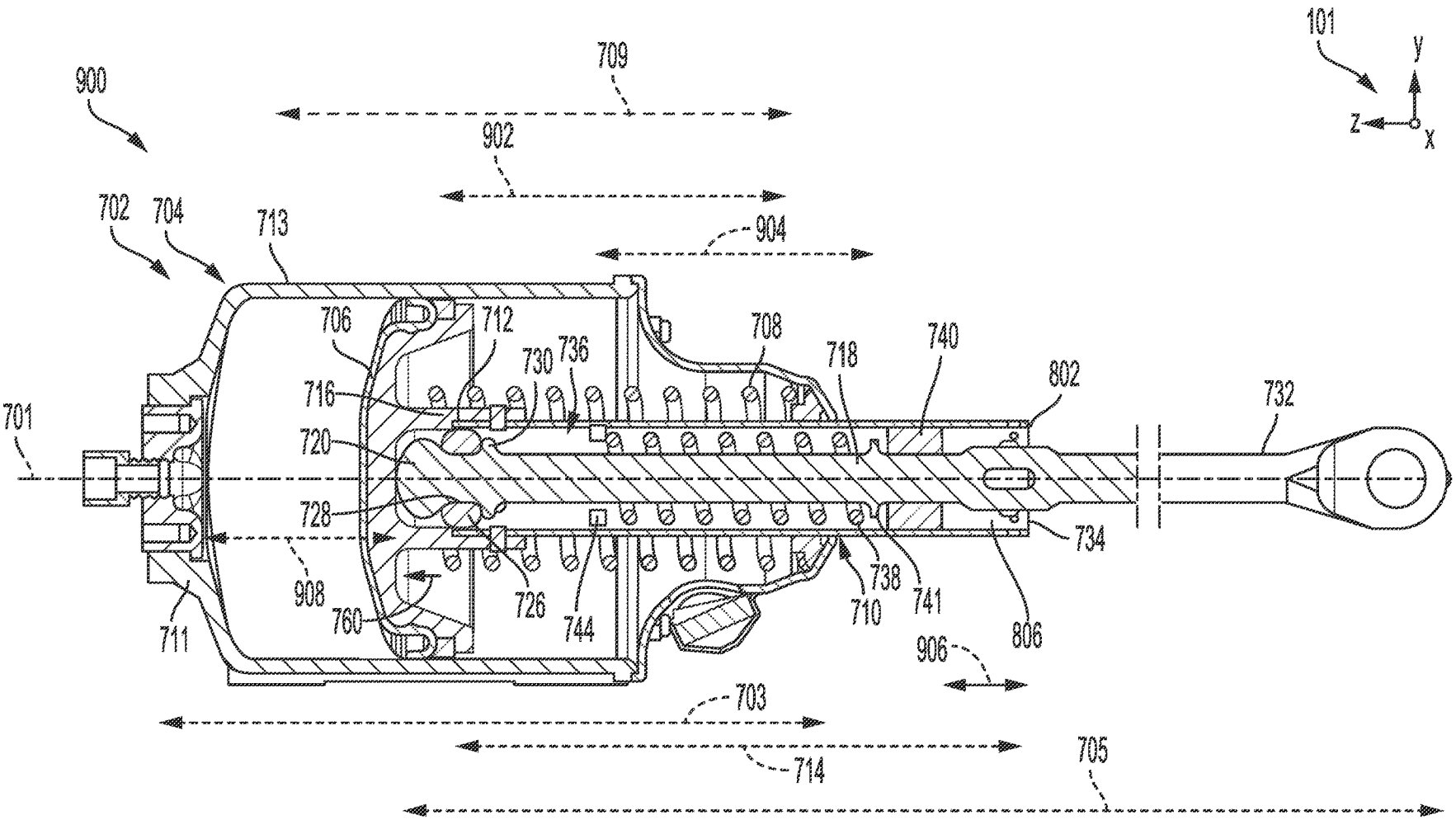
FIG. 9 shows an example of the pneumatic actuator equipped with the retention spring in a third position.
Figure 10:
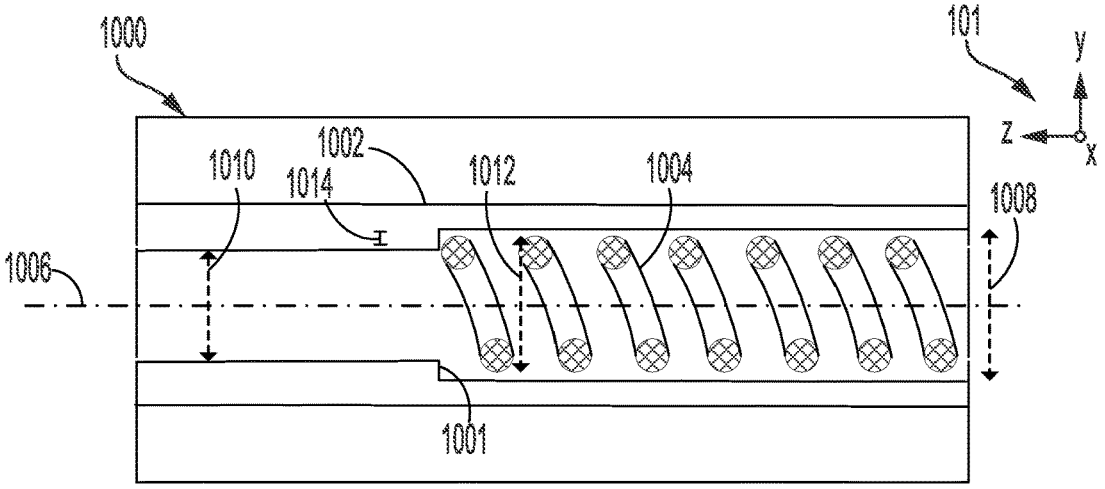
FIG. 10 shows a first example of a spring seat that may be implemented in a pneumatic actuator equipped with a retention spring.
Figure 11:
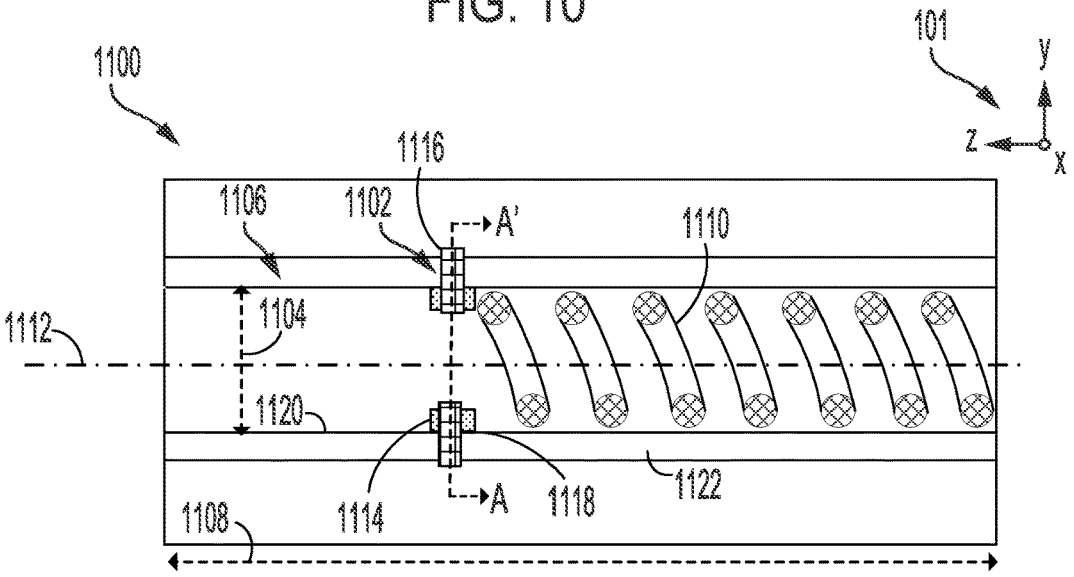
FIG. 11 shows a second example of a spring seat that may be implemented in a pneumatic actuator equipped with a retention spring.
Figure 12:
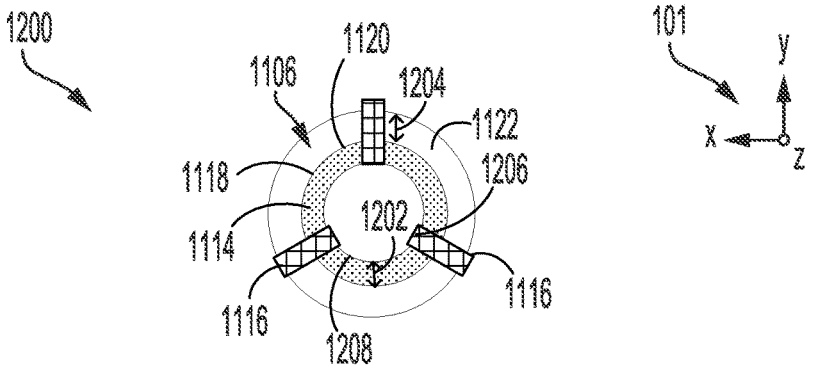
FIG. 12 shows a cross-section of the spring seat of FIG. 11.
Figure 13:
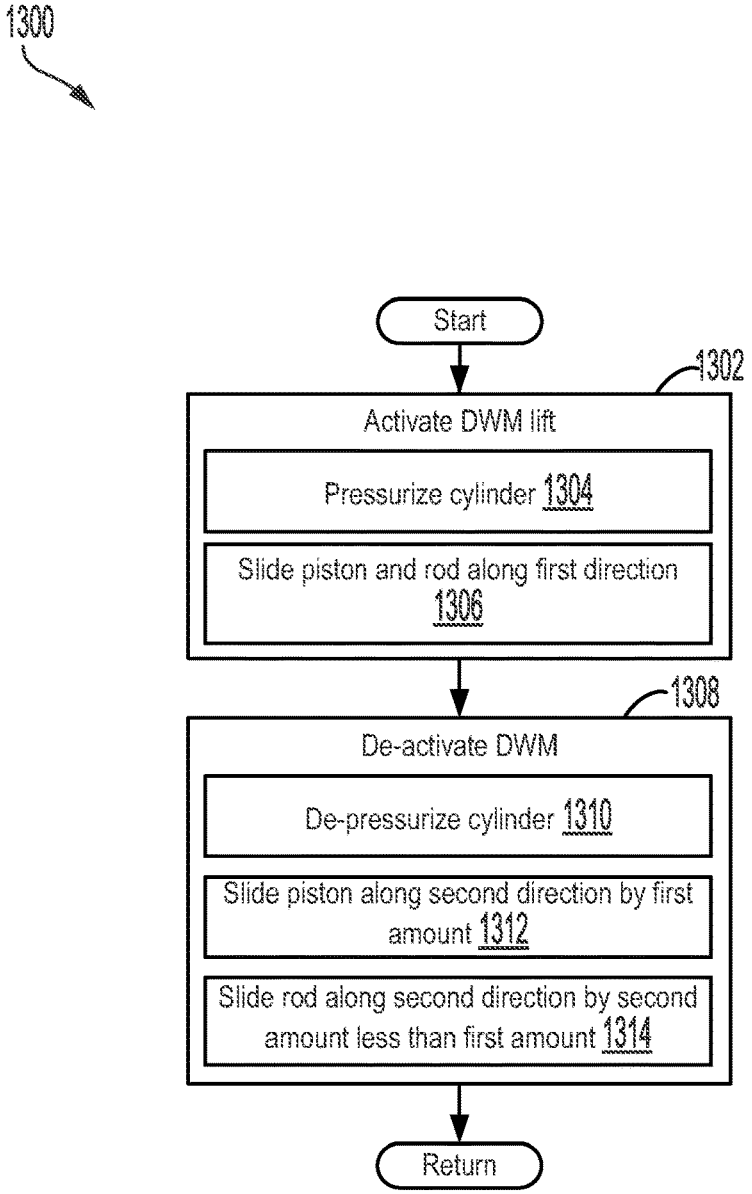
FIG. 13 shows an example of a routine for reducing slack in a linkage chain of the lift mechanism.

According to aspects of the invention, vehicles may have a chassis or truck assembly that includes lift mechanisms (e.g., suspension systems) for transferring weight among wheels and/or axles supporting the vehicle. An example of a lift mechanism enabling dynamic weight management (DWM) is shown in a schematic diagram of a rail vehicle in FIG. 1, as well as in a sectional view of a truck with the lift mechanism in FIG. 2. During DWM, a weight of the rail vehicle may be selectively and dynamically redistributed among powered and non-powered axles to accommodate vehicle operating conditions. A DWM system may include the truck, the lift mechanism, a carrier, a non-powered axle, and a linkage arrangement that links the carrier to the truck and communicates changes in load (e.g. locomotive weight) to the lift mechanism and therefore to the non-powered axle. A section of the truck that includes the lift mechanism coupled to the non-powered axle is illustrated in FIG. 3, depicting the linkage arrangement coupled to the lift mechanism and includes a linking component such as a chain linking a lever arm to the carrier of the lift mechanism. In some examples, the chain may alternate between a higher degree of tension when lifting of the lift mechanism is compelled, and slack due to a reduction in lift. When the chain is slack, and the vehicle is operating, motion, e.g., swinging, bouncing, etc., of the chain may lead to high impact contact between the chain and other components of the DWM system, such as the truck frame or a shaft retaining pin, as shown in an exploded view of the section of the truck in FIG. 4. Lift adjustment may be enabled by a pneumatic actuation system, as shown in FIG. 5, the system including one or more pneumatic actuators controlling lift provided by the DWM system. Coupling of the pneumatic actuators to a chain crank of the linkage arrangement to actuate rotation of the chain crank and thereby adjust tension in the chain is shown in FIG. 6. At least one pneumatic actuator may be adapted with a retention spring that maintains the chain taut when the DWM system is not active. The retention spring in depicted in FIGS. 7-9, affecting positioning of a piston rod relative to a piston of the pneumatic actuator when the actuator is adjusted between different operations. The retention spring may be supported by a spring seat arranged in a tube surrounding the piston. A first example of the spring seat is shown in FIG. 10 and a second example of the spring seat is shown in FIGS. 11-12. A routine for reducing slack in the chain of the DWM mechanism when lift is not demanded is shown in FIG. 13 for a system implementing the retention spring in the at least one pneumatic cylinder. Positioning of a piston rod in a pneumatic actuator between three different positions, similar to the positions shown in FIGS. 7-9, is compared in a schematic diagram depicted in FIG. 14.

FIGS. 1-12 and 14 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Figure 1:
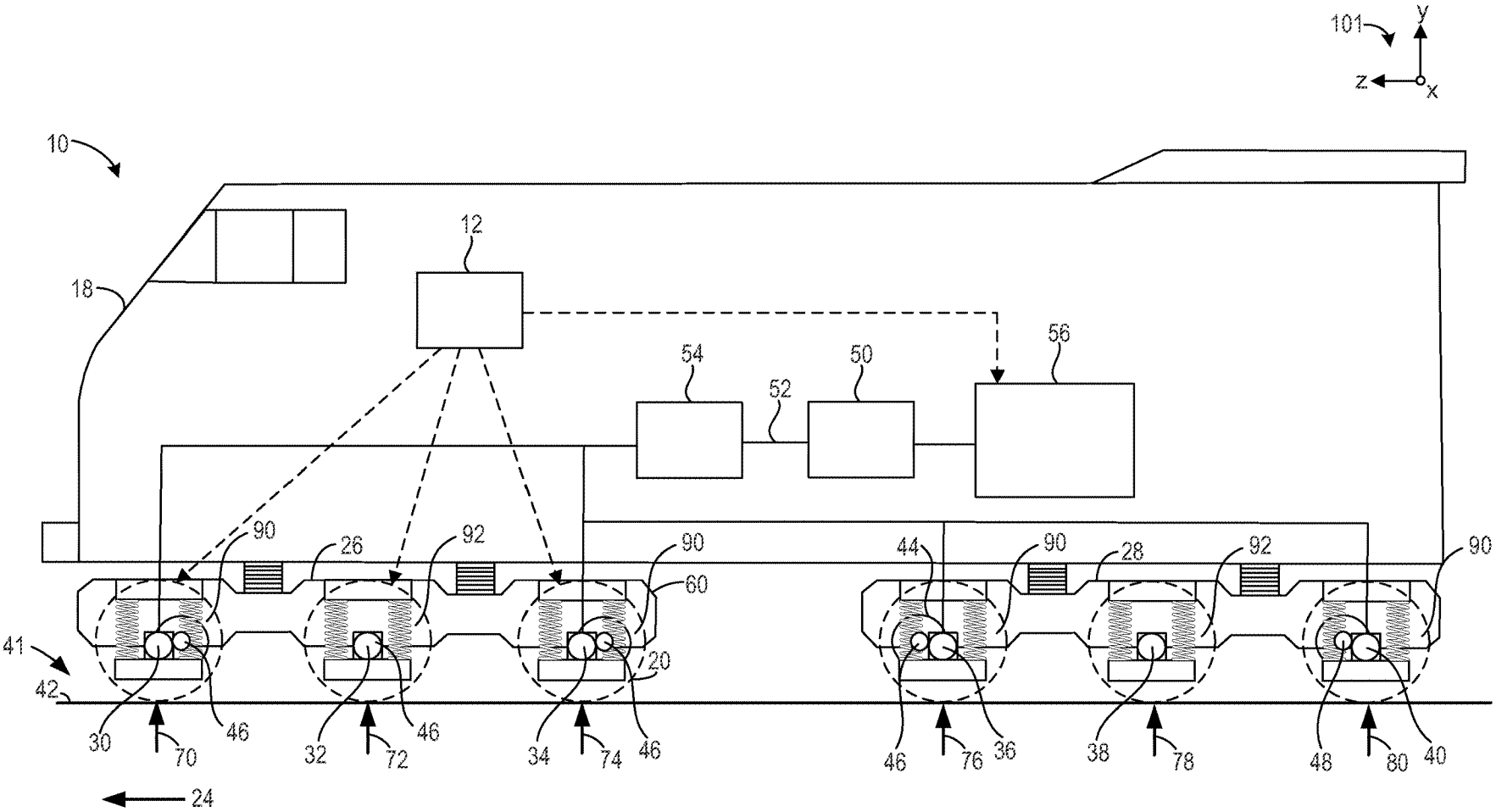
FIG. 1 shows a vehicle comprising a lift mechanism enabling dynamic weight management (DWM).

Referring to FIG. 1, a system 10 including a rail vehicle, such as locomotive 18, is illustrated. However, in alternate examples, the embodiment of system 10 may be utilized with other vehicles, including wheeled vehicles, other rail vehicles, and track vehicles. A set of reference axes 101 are provided, indicating a y-axis, an x-axis, and a z-axis. In some examples, the y-axis may be parallel with a vertical direction, the x-axis parallel with a horizontal direction, and the z-axis with a transverse direction, perpendicular to the y-axis and the x-axis. With reference to FIG. 1, the system 10 is provided for selectively and/or dynamically affecting a normal force 70, 72, 74, 76, 78, 80 applied through one or more of a plurality of axles 30, 32, 34, 36, 38, 40. The rail vehicle 18 illustrated in FIG. 1 can travel along a track 41, and includes a plurality of wheels 20 that are each received by a respective axle 30, 32, 34, 36, 38, 40 of the plurality of axles. Because the vehicle in this example is a locomotive, the route over which it travels is a track 41 and includes a pair of rails 42. The plurality of wheels 20 received by each axle 30, 32, 34, 36, 38, 40 move along a respective rail 42 of track 41 along a travel direction 24.

As illustrated in the example embodiment of FIG. 1, the rail vehicle 18 includes a pair of interchangeable trucks 26, 28 which are configured to receive the respective plurality of axles 30, 32, 34, and 36, 38, 40. Trucks 26, 28 may include truck frame element 60 configured to provide compliant engagement with carriers, via a suspension. The carriers and suspension may be components of a lift mechanism that relies on a linkage arrangement to allow the lift mechanism to operate at a non-powered axle (for example, axles 32 and 38) of the rail vehicle 18. Details of the lift mechanism are described further below, with respect to FIGS. 2-4. The trucks 26, 28 are configured to be interchangeable, where one truck (26 or 28) at one end of the rail vehicle may be rotated by 180 degrees from a forward direction, e.g., along the travel direction 24, to a rear direction, e.g., opposite of travel direction 24 and then be placed or installed at the other end of the rail vehicle without any change of an interface between the truck and the vehicle body.

Each truck 26, 28 may include a pair of spaced apart powered axles 30, 34, 36, 40 and a non-powered axle 32, 38 positioned between the pair of spaced apart powered axles. In other words, truck 26 includes powered axles 30 and 34 with non-powered axle 32 arranged there-between, while truck 28 includes powered axles 36 and 40 with non-powered axle 38 arranged there-between. The powered axles 30, 34, 36, 40 are each respectively coupled to a traction motor 44 and a gear 46. Although FIG. 1 illustrates a pair of spaced apart powered axles and a non-powered axle positioned there-between within each truck, the trucks 26, 28 may include any number of powered axles and at least one non-powered axle, within any positional arrangement.

Each of the powered axles 30, 34, 36, and 40 include a suspension 90, and each of the non-powered axles 32 and 38 include a suspension 92. The suspensions may include various elastic and/or damping members, such as compression springs, leaf springs, coil springs, etc. In the depicted example, the non-powered axles 32, 38 may include a DWM actuator (not shown) configured to dynamically adjust a compression of the non-powered axle suspensions by exerting an internal compression force. The DWM actuator may be, for example, a pneumatic actuator, a hydraulic actuator, an electromechanical actuator, and/or combinations thereof. A vehicle controller 12 may be configured to activate the DWM actuators in response to an engage command, thereby activating the suspensions of the DWC mechanism and performing dynamic weight management (DWM). By adjusting the compression of the non-powered axle suspensions, weight may be dynamically shifted from the non-powered axle 32 to the powered axles 30, 34 of truck 26. In the same way, dynamic weight shifting can also be carried out in truck 28. As such, it is possible to cause a decrease in a downward force on the non-powered axles 32, 38 and increase the tractive effort of the rail vehicle 18 via a corresponding increase in a downward force on the powered axles 30, 34, 36, 40. For example, the weight imparted by the powered axles 30, 34 and 36, 40 on the track may be increased, while the weight imparted by the non-powered axles 32, 38 on the track is correspondingly decreased. In an alternative way, an actuator can exert force on non-powered axles to impact dynamic axle weight. A force to separate the powered axles from the truck frame would increase the axle weight.

Returning to FIG. 1, as depicted, in one example, the rail vehicle is a diesel-electric locomotive operating with a diesel engine 56. However, in alternate embodiments, alternate engines and motive power devices may be employed. Other suitable engines may include a gasoline engine, a biodiesel engine, an alcohol engine, or natural gas engine. Other prime movers may include catenary, fuel cells or battery-operated systems. The vehicle may be fully electric (as with the catenary and/or battery-operated). A traction motor 44, mounted on each truck 26, 28, may receive electrical power from alternator 50 via DC bus 52 to provide tractive power to propel the rail vehicle 18. As described herein, traction motor 44 may be an AC motor. Accordingly, an inverter 54 paired with the traction motor may convert the DC input to an appropriate AC input, such as a three-phase AC input, for subsequent use by the traction motor. In alternate embodiments, traction motor 44 may be a DC motor directly employing the output of the alternator after rectification and transmission along the DC bus. One example configuration includes one inverter/traction motor pair per wheel axle. As depicted herein, 4 inverter-traction motor pairs are shown for each of the powered axles 30, 34 and 36, 40.

Traction motor 44 may act as a generator providing dynamic braking to brake locomotive 18. In particular, during dynamic braking, the traction motor may provide torque in a direction that is opposite from the rolling direction thereby generating electricity that is dissipated as heat by a grid of resistors (not shown) connected to the electrical bus. In one example, the grid includes stacks of resistive elements connected in series directly to the electrical bus. Suitable brakes may include air brakes. Air brakes (not shown) make use of compressed air and may be used as part of a vehicle braking system.

As noted above, to increase the traction of driven axles of the truck (by effecting a weight shift dynamically from at least one axle of the truck to at least another axle of the truck), one embodiment uses pneumatically actuated relative displacement between the non-powered axle (e.g., 32 and/or 38) and the truck frame element 60. The relative displacement of the non-powered axle causes a change (e.g., compression) of the axle suspension 92, thus causing a shift of weight to the powered axles (and additional compression of the suspension 90) to compensate for the reduced normal force 72 at the non-powered axle. This action generates an increased normal force 70, 74 on the powered axles 30, 34, for example.

A lift mechanism, e.g., an adjustable suspension system affecting weight distribution among axles of a vehicle, may be incorporated in a truck of a vehicle such as a rail vehicle to enable variation in a tractive force of the rail vehicle wheels on a set of rails. In one example, the lift mechanism includes a set of springs and a carrier engaged with the set of springs. A linkage arrangement may be coupled to the lift mechanism, connecting components of the truck to the lift mechanism and allowing the connection to transfer motion. The transfer of motion allows a force applied to the lift mechanism to be increased or decreased, adjusting an amount of lift implemented by the lift mechanism at the non-powered axles. Incorporation of a lift mechanism in a truck is depicted FIG. 2 in a detailed view 200 of the front truck 26 of FIG. 1.

Figure 2:
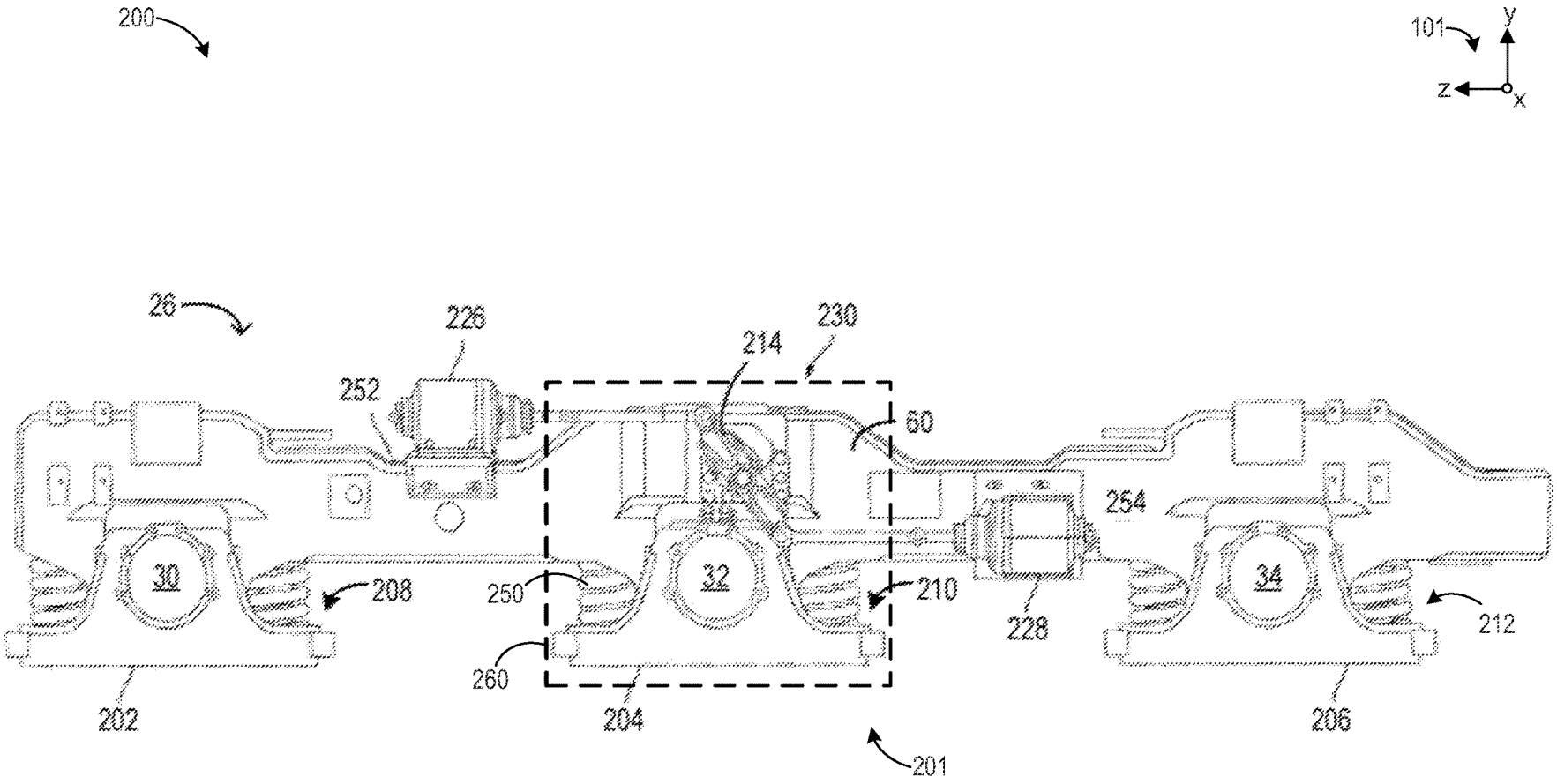
FIG. 2 shows a sectional view of an example truck including the lift mechanism of FIG. 1.

In FIG. 2, the detailed view 200 includes a lift mechanism 201 (herein also referred to as a DWM mechanism) for dynamically redistributing weight between powered and un-powered axles. While the depicted example represents an example truck configuration in the front truck 26, a similar configuration may also be included in the rear truck 28 of FIG. 1. As depicted, truck 26 may include the truck frame element 60 configured for compliant engagement with carriers 202, 204, 206, via the lift mechanism 201. In the embodiment of FIG. 2, spring systems 208, 210, 212 represent the vehicle lift mechanism 201. Each carrier 202, 204, 206 may be configured to hold respective axles 30, 32, 34. Specifically, the carriers may be configured as bearings, or the like, configured to carry the axle. Each spring system 208, 210, 212 provides a structure configured to support respective portions of the truck frame element 60, and portions of the overlying weight of the rail vehicle 18, and thereby bias the truck frame element 60 upward, and away from the carriers 202, 204, 206.

In some examples, portions of the weight supported by each carrier 202, 204, 206, and consequently the upward normal forces 70, 72, 74, on each of the wheels 20 (as shown in FIG. 1) may be selectively, and in some examples, dynamically, redistributed among the carriers 202, 204, 206. In some examples, the weight may be redistributed via a weight transference configured to decrease the weight on the non-powered axle 32, thereby increasing the weight on the powered axles 30, 34 and consequently the tractive effort of the rail vehicle 18 of FIG. 1 via a corresponding increase in the normal forces 70, 74 on the powered wheels. Truck 28 of FIG. 1 may also be similarly constructed such that the weight on the non-powered axle 38 may be decreased, increasing the weight on the powered axles 36, 40 and consequently the tractive effort of rail vehicle 18.

Various actuating arrangements may be employed to reduce the weight on the non-powered axle 32. For example, a pair of actuators 226, 228 in FIG. 2 may be coupled with the truck frame element 60. A first actuator 226 may be coupled to, or near, a top surface 252 of the truck frame element 60, and a second actuator 228 may be coupled to, or near, a lower surface 254 of the truck frame element 60. The actuators may be configured to share the actuating load for actuating a linkage arrangement 230. Specifically, the actuators may each generate forces in opposite directions, yet offset from one another, to generate a coupling torque that rotates a cam or lever arm 214 to generate lifting force on carrier 204 to displace it relative to, and toward, truck frame element 60. Mechanical advantage may be used by the linkage arrangement 230 to amplify the force from the actuators, and in some examples the mechanical advantage may vary depending on the position of the linkage arrangement 230. In one example, the actuators 226, 228 may be pneumatic actuators (as elaborated in FIG. 5). In alternate examples, additionally or optionally, hydraulic, magnetic, and/or various direct or indirect actuators may be used, including but not limited to using one or more servo motors, and the like. Various configurations and numbers of actuators may be employed. In alternate embodiments, the actuators could be coupled to both powered and non-powered axles.

The actuatable linkage arrangement 230 includes a compliant linkage coupled to the carrier 204 to translate rotation of the lever arm 214, as compelled by a pneumatic actuator-generated couple, into vertical motion of the carrier 204 relative to the truck frame element 60. Lever arm 214 may be coupled with a crank (not shown) and may be configured to effect the pivoting of the crank. The two actuators 226, 228 may be configured to exert forces from respectively opposite directions to exert the couple, e.g., the moment of the couple, on the lever arm 214. In one example, the compliant linkage may include a chain, as shown in FIGS. 3 and 4. In alternate examples, the linkage may include a cable, a strap, a rope, slotted rigid members, or the like. The chain may be able to operate in tension (hereafter referred to as a truck chain tension) to support a load at least an order of magnitude, and often two or more orders of magnitude, greater than that in compression.

Tension on the chain may be imposed by forces acting on the chain to compel extension of the chain. For example, tension may be placed on the chain by attaching a first end of the chain to a first object and a second end of the chain to a second object and exerting a force on at least one of the objects in a direction away from the other object. An amount of tension on the chain may be zero or a value greater than zero.

As another example, tension on the chain may be defined by rotation of lever arm 214. A number of degrees through which the lever arm 214 may be rotated may correspond to an initial tightening and lengthening of the chain so that the chain becomes linear, compared to when the chain is slack and not linear, when the lever arm 214 is rotated and the first end of the chain is attached to the lever arm 214 and the second end is anchored to another object. In other words, when the chain is relaxed and slack, a length of the chain, e.g., a distance between ends of the chain, may be less than when tension on the chain increases to at least a threshold amount, pulling the chain taut. Herein, taut may define a configuration of the chain when the chain is linearly aligned, e.g., straight. The length of the chain extending between the lever arm 214 and the object may reach a maximum as the lever arm 214 continues to rotate. Further rotation of the lever arm 214 rotated along a direction that provides lift by the lift mechanism 201 may eventually reach a maximum amount of tension exerted on the chain. The position of the lever arm 214 may have a defined relationship with tension experienced by the chain. By enabling the compliant linkage, e.g., the chain, to pull the carrier against the bias in a first direction, it is possible to selectively control increased compression of the spring system 210 to shift the truck frame element 60 toward the carrier 204 and effect a dynamic re-distribution of the load to other axles of the truck assembly.

Alternatively, when the compliant linkage is relaxed, allowing the truck frame 60 to shift away from the carrier 204 and with the bias in a second direction, opposite the first direction, at least a portion of the load may be transmitted to the non-powered axle 32. When relaxed the compliant linkage may be of a length that provides slack in the compliant linkage to accommodate changes in distance, along the y-axis, between a DWM shaft, as shown in FIGS. 3-4, to which the compliant linkage is coupled and the carrier 204 during vehicle motion. When relaxed, the compliant linkage may be nonlinear. The DWM shaft may bounce up and down, for example, through a 2.5 inch margin, and compliance in the length of the compliant linkage may allow the vertical oscillation of the DWM shaft to occur without altering the loads on the non-powered and powered axles.

Spring system 210 may include one or more springs 250 configured to couple the axle to the truck frame element 60. While FIG. 2 shows two springs biasing each carrier away from the truck frame element 60, more or less springs may be used. A top end of each spring may be attached to the truck frame element 60, and a bottom end of each spring to carrier 204. In one example, as illustrated in FIG. 2, the spring system 208 for powered axle 30 may be substantially similar to the spring system of each powered axle 34, 36, and 40, such as when the rail vehicle can operate in both forward and reverse directions. However, in an alternative example, a front truck may require a greater lift force to compress the carrier 204 than on a rear truck due to the natural weight transfer within the truck or the rail vehicle. As such, the spring system 208 may be used only for axles 30 and 34, but not on axles 36 and 40.

In one example embodiment, spring system 208 may be configured to provide a non-linear spring rate in response to a deflection between powered axles 30 and 34 and truck frame element 60. In alternate embodiments, spring system 208 may be linear and may provide a spring rate substantially similar to that of spring system 210.

A central section 302 of a truck configuration, which may represent a region of the truck 26 of FIG. 2 as indicated by a dashed rectangle 260, is depicted in a perspective view 300 in FIG. 3 and in an exploded view 400 in FIG. 4. A suspension system of a lift mechanism, e.g., the spring systems 208, 210, and 212 of FIG. 2, are omitted from FIGS. 3 and 4 for simplicity. Common components are similarly numbered in FIGS. 3 and 4. The central section 302 of the truck configuration includes a truck frame 304, a carrier 306 of the lift mechanism, which may be similar to the carrier 204 of FIG. 2, and a linkage arrangement 308. The truck frame 304 is positioned above the carrier 306, with respect to the y-axis, and spaced away from the carrier 306, e.g., surfaces of the truck frame 304 are not in contact with surfaces of the carrier 306.

The carrier 306 has a base 310 with a width 312, defined along the z-axis, greater than a width of an upper portion 314 of the carrier 306. The width 312 of the base 310 may be configured to accommodate an arrangement of springs, e.g., the spring systems 208, 210, and 212 of FIG. 2, at opposite sides of the upper portion 314 within the base 310. The upper portion 314 has a central aperture 316, extending entirely through a thickness 318 of the upper portion, defined along the x-axis, through which an axle, such as the axle 32 of FIG. 2, may be inserted.

The carrier 306 may be coupled to the truck frame 304 by the linkage arrangement 308. The linkage arrangement 308 includes a crank assembly 320 and a chain 340. The chain 340 may extend between a chain crank 322 of the crank assembly 320 and a top surface 324 of the carrier 306. In one example, the chain crank 322 may be the lever arm 214 of FIG. 2. More specifically, a first link 342 of the chain 340 may surround a first end 326 of the chain crank 322 and a fourth link 344 of the chain 340 may surround an anchoring pin 346, the first link 342 and the fourth link 344 representing terminal ends of the chain 340. The anchoring pin 346 may be secured to the top surface 324 of the carrier 306 by threading the anchoring pin 346 through a pair of brackets 348. The pair of brackets 348 may be integrated into a material of the top surface 324, e.g., by casting as a continuous unit, and a distance 350 that the chain extends between the first end 326 of the chain crank 322 and the top surface 324 of the carrier 306 may depend on adjustment of the lift mechanism, as described further below.

It will be appreciated that while the chain 340 is shown in FIGS. 3 and 4 with four links, other examples may vary in a number of links included in the chain or vary in respective dimensions of the links. For example, a chain may similarly have four links but the links may be shorter or longer along the y-axis than the chain 340 of FIGS. 3 and 4 and thereby extend a smaller or larger distance between the chain crank 322 and the carrier 306. As another example, a chain may have two links, three links, or five links instead of four. Various alternatives to the chain 340 shown in FIGS. 3 and 4 have been envisioned without departing from the scope of the present disclosure.

The crank assembly 320 may incorporate several components that, together, allow the chain crank 322 to be pivoted about a DWM shaft of the crank assembly, such as a DWM shaft 402 shown in FIG. 4. The carrier 306 of FIG. 3 is omitted from the exploded view 400 of FIG. 4 for simplicity. In FIG. 4, the DWM shaft 402 extends through an aperture of the chain crank 322 and into an aperture 404 of the truck frame 304 at a first end 401 of the DWM shaft 402. The first end 401 of the DWM shaft 402 may be secured within the aperture 404 by a truck frame bushing 406 that allows rotation of the DWM shaft 402 relative to the truck frame 304.

A second end 403 of the DWM shaft 402 may be inserted into a chain crank bearing 408. The chain crank bearing 408 may be secured to the second end 403 of the DWM shaft 402 by a shaft retaining pin 410. The chain crank bearing 408 may couple the DWM shaft 402 to a DWM cover plate 412 which is, in turn, coupled to a T-bar 414 by a T-bar bushing 416. The components of the crank assembly 320 may be configured to transmit rotation of the T-bar 414 to rotation of the chain crank 322. When the chain crank 322 is compelled to rotate, the chain crank 322 may pivot about the DWM shaft 402. As the chain crank 322 pivots, the first end 326 of the chain crank 322 may shift up and down along the y-axis through an arc as indicated by arrow 418.

Movement of the first end 326 of the chain crank 322 may be translated to vertical movement of the chain 340. The chain 340 may be connected to the first end 326 of the chain crank 322 by a chain crank pin 420 and secured with chain crank bushings 422. The chain crank pin 420 may be inserted through apertures 424 in the first end 326 and through the first link 342 of the chain 340, the first link 342 sandwiched between the apertures 424 in the first end 326 of the chain crank 322. As such, the chain crank pin 420 locks the chain 340 to the chain crank 322.

As the linkage arrangement 308 is pivoted around the DWM shaft 402 in a first direction, e.g., clockwise when viewing the central section 302 of the truck configuration along the x-axis from the second end 403 of the DWM shaft 402 towards the first end 401, the first end 326 of the chain crank 322 may be tilted upwards, along the y-axis. The distance 350, as shown in FIG. 3, the chain 340 extends between the first end 326 of the chain crank 322 and the top surface 324 of the carrier 306 may be increased, eventually stretching the chain 340 taut and pulling the carrier 306 towards the truck frame 304.

When the linkage arrangement 308 is pivoted in a second direction, opposite of the first direction, the first end 326 of the chain crank 322 may be tilted downwards, along the y-axis. The distance 350 the chain 340 extends between the first end 326 of the chain crank 322 and the top surface 324 of the carrier 306 may decrease, reducing a space between the first link 342 and the fourth link 344 and relaxing the chain 340 and, in some examples, allowing slack in the chain 340.

The chain crank 322 may be rotated with the DWM shaft 402 acting as a fulcrum to adjust an amount of lift provided to the lift mechanism. Tilting the first end 326 of the chain crank 322 in the first direction, as described above, increases tension when tilting of the chain crank 322 passes a threshold amount of rotation on the chain 340 and drives upward motion of the chain 340, along the y-axis. The threshold amount of rotation may be, for example, 5 degrees or 10 degrees of rotation or some angle that tightens the chain 340, pulling the chain 340 taut with a minimum amount of imposed tension, before increasing tension on the chain 340 by continuing to rotate the chain crank 322. As the chain 340 is pulled up, the motion of the chain 340 also pulls the carrier 306 upwards and towards the truck frame 304, e.g., "lifting" the carrier 306, due to securing of the fourth link 344 to the anchoring pin 346 at the top surface 324 of the carrier 306. Lifting the carrier 306 compresses the spring system coupled to the carrier, e.g., the spring system 210 of FIG. 2, and redistributes a load on the carrier 306 to powered axles such as the axles 30 and 34 of FIG. 1 and increasing a tractive force of the powered axles.

Alternatively, the first end 326 of the chain crank 322 may be tilted in the second direction, relieving tension on the chain 340 by lowering the chain 340 and thereby lowering the carrier 306. As the carrier 306 is shifted downwards and away from the truck frame 304, the spring system is decompressed and the carrier 306 imposes a portion of the load onto the non-powered axle from the powered axles. As the carrier 306 shifts the load onto the non-powered axle, the chain 340 is relaxed.

Relaxing the chain 340 to an extent where slack is introduced to the chain 340 may enable a central region, e.g., links between the first link 342 and the fourth link 344, of the chain 340 to swing and move randomly in response to vehicle motion. As the central region of the chain 340 swings, the chain 340 may come into contact with the truck frame 304 and/or the top surface 324 of the carrier 306. High impact contact between the chain 340 and the truck frame 304 and/or the carrier 306 may result in abrasion and deformation of the truck frame 304 and/or the carrier 306.

Furthermore, rapid conversion between tension on the chain 340 and slack in the chain 340 may result in sudden and forceful contact between the fourth link 344 of the chain 340 and the anchoring pin 346, as shown in FIG. 3, and between the first link 342 of the chain 340 and the chain crank pin 420. As well, the chain links of the chain 340 may rub and compress against one another, causing wear and tear on the links that may lead to degradation of the links, thereby motivating replacement of the chain 340.

To reduce degradation to components of a linkage arrangement caused by changes in tension to chains linking axle carriers to a truck frame, a spring mechanism may be implemented in a DWM actuation system to maintain a minimum amount of tension on the chains, e.g., the minimum amount of tension on the chains is a nominal amount of compression at a carrier of the DWM system, to decrease random motion of the chains that may otherwise lead to degradation of adjacent DWM components. Turning now to FIG. 5, a schematic diagram 500 of an example of a pneumatic actuation system 502 that may be coupled to a lift mechanism via a linkage arrangement of a DWM system is shown. The pneumatic actuation system 502 includes a cylinder 510, which may be a non-limiting example of the actuator 226 or 228 of FIG. 2, coupled to a linkage arrangement 501, which may be the linkage arrangement 230 of FIG. 2 or 308 of FIGS. 3 and 4. The pneumatic actuation system 502 also includes a bleed or dump valve 518, a pressure regulator valve 506, and a pressure reservoir 516, arranged serially in line with the dump valve 518 proximate to and fluidly communicating with the cylinder 510 with the pressure regulator valve 506 positioned between the pressure reservoir 516 and the dump valve 518. A pressure in the pressure reservoir 516 may be maintained above ambient pressure by coupling the pressure reservoir 516 to a compressor or an exhaust system of the vehicle.

The pneumatic actuation system 502 is configured to actuate the linkage arrangement 501, and thereby a lift mechanism 503 coupled to the linkage arrangement 501 by adjusting a position of a piston 512 in the cylinder 510. The lift mechanism 503 includes a spring system 526 and a carrier 530. The position of the piston 512 may be adjusted by varying pressure in the cylinder 510 which controls an amount of lift, e.g., compression of the spring system 526, provided by the lift mechanism 503. The pressure in the cylinder 510 is regulated by activation of a combination of the pressure regulator valve 506 and the dump valve 518.

Based on a pressure command ("PSI command") issued from a controller 504, which may, in one example, be the controller 12 of FIG. 1, the pressure regulator valve 506 may be configured to provide air pressure along pneumatic line 508 to the cylinder 510. For example, the controller 504 may compute the pressure command based on a determined lift command. In one example, pressure regulator valve 506 may be a variable orifice pressure valve. Pressurized air may be supplied from pressure reservoir 516 to the pressure regulator valve 506. In one example, when a reduction in lift, or a DWM de-lift, is commanded by the controller 504 (for example, in response to the absence of lift conditions), the pressure in the pneumatic line 508 may be gradually ramped down by the pressure regulator valve 506 by slowly dissipating pressurized air to the atmosphere (atm). When reducing the lift, the controller 504 may further specify a ramp-down rate. The ramp-down rate may be based on, for example, a level of lifting, a vehicle speed, and/or a vehicle tractive effort. In another example, when the pressure commanded is lower than the pressure supplied from the pressure reservoir 516, the difference in pressure may be dissipated to the atmosphere (atm) by the pressure regulator valve 506. In another example, there may be two valves which are independently controlled, one to increase the pressure and another to decrease the pressure, and the actual pressure regulation itself may be achieved by the controller 504 using the pressure feedback. In one example, when the maximum pressure applied is limited, the line pressure may be estimated from the tractive effort obtained as well.

The pressure regulator may be coupled to the cylinder 510 along pneumatic line 508 via the dump valve 518. In one example, the dump valve 518 may be an electromagnetic dump valve alternating between an open position 520 and a closed position 522. Specifically, dump valve 518 may remain in a default closed position 522 until enabled or activated by the passage of an electric current, at which time dump valve may shift to the open position 520. In response to a detected "dump" command, the controller 504 may activate the dump valve to open and the pressure in pneumatic line 508 may be "dumped" to the atmosphere, rapidly and almost instantaneously bringing the air pressure in the line down, for example, down to a range of 0-5 psi (0-34 kPa). In this way, a quick deactivation of the lift mechanism may be provided, for example, in response to a sudden application of friction brakes during an emergency air brake event. Thus, a more rapid lift reduction may be achieved to thereby reduce sliding of the axle.

When rapid lift reduction is requested and a minimum amount of lift for a minimum lift operation is also desired to maintain a chain of the linkage arrangement sufficiently taut to reduce swinging of the chain, the dump valve 518 may be first adjusted to the open position 520 to dissipate pressure to or near ambient pressure. The dump valve 518 may then be shifted to the closed position 522 and the pressure regulator valve 506 opened to allow the pressure in the cylinder to reach a target pressure, such as 7-10 psi (48-69 kPa).

A controlled deactivation of the DWM mechanism may be used during a de-lift operation (e.g., during an operation wherein the rail vehicle is changed from operating with lift to operating with no lift, or less lift). It will be appreciated that while the figure depicts a single cylinder coupled to a single spring of the spring system by way of the linkage arrangement 501, a similar command may be given in parallel to another cylinder linked to a second spring of the spring system.

During a DWM lift operation, dump valve 518 may remain closed and pressure regulator valve 506 may generate a pressure in the pneumatic line 508 based on the commanded pressure. A pressure sensor 524 may monitor the pressure (P) in the line. The commanded pressure may be transferred to side cylinder 510. The movement of side cylinder 510 may then be relayed to and transformed into a corresponding lift in spring system 526, which, in one example, may be the spring system 210 of FIG. 2. In one example, when an increase in lift is indicated, movement of side cylinder 510 may enable springs 528 of spring system 526 to decrease their compression rate, thereby bringing carrier 530 closer to truck frame 532, which may be, for example, the carrier 306 and truck frame 304 of FIG. 3. In another example, when a decrease in lift is commanded (or when a DWM de-lift is commanded), the movement of side cylinder 510 may enable springs 528 of spring system 526 to increase their compression rate, thereby pushing carrier 530 further from truck frame 532. The controller 504, when performing DWM control, is responsible for the air pressure on the DWM pneumatic cylinders, which in turn shift weight from non-powered to powered axles on the rail vehicle. In one example, a push mechanism is used to perform the DWM lift under some conditions and an alternate mechanism (such as a pull mechanism) is used to perform a DWM de-lift under different conditions.

At least one cylinder, e.g., the cylinder 510 of FIG. 5, may be coupled to a chain crank, e.g., the chain crank 322 of FIGS. 3 and 4, of a linkage arrangement. In some examples, as shown in an example embodiment of a section of a truck configuration 600 in FIG. 6, a first cylinder 602, which may be a non-limiting example of the cylinder 510 of FIG. 5, may be aligned with the z-axis and attached or tethered to a first end 604 of a T-bar 606 of a crank assembly 608 by a first piston rod 603 extending between a first piston 650 of the first cylinder 602 and the first end 604 of the T-bar 606. A second cylinder 610, which may also be used similarly as the cylinder 510 of FIG. 5, may also be aligned along the z-axis and tethered to a second end 612 of the T-bar 606, the second end 612 opposite of the first end 604, by a second piston rod 605 extending between a second piston 660 of the second cylinder 610 and the second end 612 of the T-bar 606. The first cylinder 602 and the second cylinder 610 may be positioned on opposite sides of the T-bar 606, along the z-axis. Motion of the first piston rod 603 and the second piston rod 605 along the z-axis in and out of the first and second cylinders 602 and 610, respectively, is indicated by arrows 630.

As an example, the crank assembly 608 may be configured opposite of the crank assembly 320 of FIGS. 3 and 4. In such a configuration, a chain crank may pivot about a DWM shaft as a fulcrum and include a lever arm that extends to the right of the DWM shaft, instead of the left as down in FIGS. 3 and 4. A linkage chain may be coupled to an end of the lever arm distal to the DWM shaft (not shown in FIG. 6). To rotate the T-bar 606 clockwise and decrease lift (e.g., adjust a lift mechanism 618 to a de-lifted configuration) at a non-powered axle 614 coupled to a carrier 616, a pressure at the first cylinder 602 may be decreased, pulling the first piston rod 603 and the first piston 650 to the right and into the first cylinder 602. Concurrently, a pressure at the second cylinder 610 may also be decreased, pulling the second piston rod 605 and the second piston 660 to the left and into the second cylinder 610. Retraction of both the first and second piston rods 603, 605 into their respective cylinders drives clockwise pivoting of the T-bar 606 and the chain crank, the chain crank coupled to the T-bar 606 by components of the crank assembly 608.

To rotate the T-bar 606 counterclockwise and increase lift at the non-powered axle 614 coupled to a carrier 616, a pressure at the first cylinder 602 may be increased, pushing the first piston rod 603 and the first piston 650 to the left and out of the first cylinder 602. Concurrently, a pressure at the second cylinder 610 may also be increased, pushing the second piston rod 605 and the second piston 660 to the right and out of the second cylinder 610. Extension of both the first and second piston rods 603, 605 out of their respective cylinders drives counterclockwise pivoting of the T-bar 606 and chain crank.

As described above, when the lift at the carrier 616 is reduced, and in particular, when the carrier is de-lifted to a maximum extent, slack, e.g., looseness, in a chain linking the carrier 616 to a truck frame 620 (such as the chain 340 of FIGS. 3 and 4) may result in forceful, compressive contact between the chain and components of the linkage arrangement, including the crank assembly 608, the carrier 616, the truck frame 620 and the chain. For example, the truck frame 620 may bounce up and down, along the y-axis, due to vibrations generated during vehicle navigation. As the truck frame 620 bounces, slack in the chain varies, and when the truck frame 620 moves downwards by a distance greater than a threshold distance, the chain (or links of the chain) may be compressed between the truck frame 620 and the carrier 616 due to increased slack in the chain. By maintaining the chain taut even when lift is not requested of the DWM mechanism, such contact may be reduced. In one example, the chain may be kept taut by implementing a retention spring in pneumatic actuators of the DWM mechanism, such as the cylinder 510 of FIG. 5 and the first and second cylinders 602, 610 (respectively) of FIG. 6. The retention spring may control a positioning of piston rods within the pneumatic actuators and may be held in place by a spring seat. Cutaway views of an arrangement of a retention spring in a cylinder 702 are shown in FIGS. 7-9, depicting the cylinder in a first position 700, a second position 800, and a third position 900, respectively. In some examples, the cylinder 702 may be a non-limiting example of the second cylinder 610 of FIG. 6.

A first side cutaway view of the cylinder 702 is shown in FIG. 7. The cylinder 702 has a central axis 701 and includes an outer housing 704 surrounding inner components of the cylinder 702, such as a piston 706 and a first spring 708, (which may be referred to herein as a returning spring 708), coiled around a piston casing or tube 710, the piston tube 710 coupled at a first end 712 to an inner sleeve 716 of the piston 706. The outer housing 704 includes a front wall 711, arranged perpendicular to the central axis 701 and a side wall 713 parallel with the central axis 701. The piston tube 710 extends along the central axis 701 aligned with the central axis 701, and extending along a portion of an overall length 703 of the cylinder 702. The returning spring 708 may circumferentially surround the piston tube 710 along a portion of a length 714 of the piston tube 710 as well as the inner sleeve 716 of the piston 706.

The returning spring 708 may be arranged between the outer housing 704 and the piston tube 710, spaced away from both but separated by a smaller distance from the piston tube 710 than from the outer housing 704. The returning spring 708 may be in contact with an outer surface of the inner sleeve 716 of the piston 706. The returning spring 708 may be flexible along the central axis 701, e.g., returning spring 708 may contract in length along the central axis 701 when an external force is applied and have a stiffness that returns the returning spring 708 to a first length 709 of the returning spring 708 when the external force is removed. In the first position 700, the returning spring 708 may exert a spring force on the piston 706 in a direction indicated by arrow 760, maintaining the piston in contact with the front wall 711 of the outer housing 704 of the cylinder 702.

A rod 718 may be positioned within the piston tube 710, in contact with the piston 706 at a head 720 of the rod 718. The head 720 of the rod 718 may be a first terminal end of the rod 718 that is rounded along all axes and has a wider diameter 722 than a diameter 724 of a central portion of the rod 718. A rubber ring 726 may surround a neck 728 of the rod 718, the neck 728 extending between the head 720 and a first retaining lip 730 of the rod 718. The rod 718 has a greater length 705 than either the piston tube 710 or the cylinder 702 and extends from the head 720 of the rod 718 to a second end, or tail 732 protruding out of the piston tube 710 at a second end 734 of the piston tube 710. The tail 732 of the rod 718 may couple to a chain crank of a DWM mechanism, such as the chain crank 322 of FIG. 3.

The rod 718 is spaced away from an inner surface of the piston tube 710 so that the rod 718 does not contact the piston tube 710 at any point along the length 705 of the rod 718. In a space between the piston tube 710 and the rod 718, a second spring 736, hereafter a retention spring 736, may be disposed, extending along the central axis 701. The retention spring 736 may coil around the rod 718 along a portion of the length 705 of the rod 718 that is enclosed within the piston tube 710. The retention spring 736 may be less flexible, e.g., more stiff and more resistant to compression and expansion along the central axis 701 than the returning spring 708. The first length 707 of the retention spring 736 may represent a length of the retention spring 736 when the retention spring 736 is compressed by a first compression amount.

The retention spring 736 is maintained compressed by the first compression amount by a retention device 750 which may engage with the piston tube 710 and the rod 718 to hold the rod 718 in place relative to the piston tube 710. In some examples, the retention device 750 may be a pin, as shown in FIG. 7. In other examples, the retention device 750 may be a clamp, a clip, or some other device sufficiently strong to resist expansion of the retention spring. The retention device 750 within the piston tube 710 near the second end 734 of the piston tube 710, inserted through an opening in 751 in the rod 718. When compressed, a stiffness of the retention spring 736 results in the retention spring 736 exerting a spring force at the first end 742 of the retention spring 736 along a direction indicated by arrows 715. The retention spring 736 also exerts a spring force at a second end 738 of the retention spring 736 along a direction indicated by arrows 717.

The second end 738 of the retention spring 736 may abut a second retaining lip 741, the second retaining lip 741 similar to the first retaining lip 730, for example. However, in other examples, the second retaining lip 741 may protrude outwards and away from the central axis 701 a greater distance than the first retaining lip 730. The second end 738 of the retention spring 736 may contact and press against a side of the second retaining lip 741 facing the front wall 711 of the outer housing 704 of the cylinder 702. In this way the second retaining lip 741 inhibits further extension of the second end 741 of the retention spring 736 along the central axis 701, e.g., in a direction away from the front wall 711 of the outer housing 704 of the cylinder 702. The second end 738 of the retention spring 736 may be maintained in place, in spite of external forces applied to the retention spring 736, by abutting the second retaining lip 741. In another example, a spring seat may be fixedly attached to the rod 718 at a same location along the rod 718 as the second lip 741 and in place of the lip 741. The spring seat may be similar to the sprint seats described below, with reference to FIGS. 10-12, but coupled to the rod 718 instead of the piston tube 710. In other examples, the second end 738 of the retention spring 736 may be secured in place relative to the rod 718 by a variety of other mechanisms and devices without departing from a scope of the present disclosure.

A foam collar 740 may completely fill the space between the rod 718 and the piston tube 710 at a point along the length 705 of the rod 718 between the second end 734 of the piston tube 710 and the second end 738 of the retention spring 736. The foam collar 740 may impede entry of dirt and debris into the piston tube 710 and may be configured to move with the rod 718 within the piston tube 710. For example, the foam collar 740 may slide along the central axis 701 when the rod 718 slides along the central axis 701 so that a position of the foam collar 740 along the rod 718 does not change.

The retention spring 736 extends along the central axis 701 towards the head 720 of the rod 718 from the second end 738 to the first end 742 of the retention spring 736. The first end 742 of the retention spring 736 may contact and press against a spring seat 744 that blocks further extension of the first length 707 of the retention spring 736 along the central axis 701. The spring seat 744 may be a non-moving structure (e.g., fixed in position relative to retention spring 736), either integrated into the piston tube 710 or coupled to the piston tube 710. Example embodiments of the spring seat 744 are shown in FIGS. 10-12.

A first example 1000 of a spring seat 1001 is shown in FIG. 10. The spring seat 1001 may be arranged in a piston tube 1002, which may be a non-limiting example of the piston tube 710 of FIGS. 7-9. A retention spring 1004 extends along a central axis 1006 of the piston tube 1002, enclosed within the piston tube 1002. The spring seat 1001 may be an abrupt narrowing of an inner diameter of the piston tube 710, creating a ledge that forms the spring seat 1001. For example, a first inner diameter 1008 of the piston tube 1002 to the right of the spring seat 1001, where the retention spring 1004 is situated, may be wider than a second inner diameter 1010 of the piston tube 1002 to the left of the spring seat 1001.

The spring seat 1001 is a ledge jutting inwards, towards the central axis 1006 and perpendicular to the central axis 1006, extending around an entire inner circumference of the piston tube 1002. The second inner diameter 1010 of the piston tube 1002 may also be narrower than an outer diameter 1012 of the retention spring 1004. As a result, the spring seat 1001 is in contact with the retention spring 1004 and blocks extension of the retention spring 1004 to the left, beyond the spring seat 1001. The spring seat 1001 may be implemented, as an example, by forming the piston tube 1002 with the spring seat 1001 integrated into the piston tube 1002, e.g., by casting or molding. Alternatively, the spring seat 1001 may be a sleeve formed separately from the piston tube 1002 and inserted into the piston tube 1002. A position of the sleeve may be maintained within the piston tube 1002 by some securing method or mechanism, such as welding, retention pins, interference fit or bolts.

A protrusion of the spring seat 1001 towards the central axis 1006 may be a distance 1014 that sufficiently resists extension of the retention spring 1004 and maintains the retention spring to the right of the spring seat 1001 without impeding sliding of a rod, e.g., the rod 718 of FIGS. 7-9. In other words, the spring seat 1001 does not come into contact with the rod. The distance 1014 the spring seat 1001 extends towards the central axis 1006 may be varied based on a diameter of the rod, a thickness of the retention spring 1004 and an inner diameter of the piston tube 1002.

A second example 1100 of a spring seat 1102 is shown in FIG. 11. An inner diameter 1104 of a piston tube 1106 in which the spring seat 1102 is implemented may be uniform along a length 1108 of the piston tube 1106. A retention spring 1110 is arranged in the piston tube 1106, extending along a central axis 1112 of the piston tube 1106, to the right of the spring seat 1102. Extension of the retention spring 1110 along the central axis 1112 to the left may be halted by contact between the retention spring 1110 and the spring seat 1102.

The spring seat 1102 may include a ring 1114 and a plurality of pins 1116. An outer diameter of the ring 1114 may be equal to the inner diameter 1104 of the piston tube 1106 so that an outer edge 1118 of the ring 1114 is in face-sharing contact with an inner surface 1120 of the piston tube 1106 around an entire circumference of the ring 1114. The plurality of pins 1116 may be inserted through openings in the rings and correspondingly aligned apertures in a wall 1122 of the piston tube 1106, as shown in FIG. 12. A cross-section 1200 of the spring seat 1102, taken along line A-A' in FIG. 11, is depicted. The cross-section 1200 depicts a concentric arrangement of the ring 1114 within the piston tube 1106. The plurality of pins 1116 may extend entirely through a thickness 1202 of the ring 1114 as well as at least a portion of a thickness 1204 of the wall 1122 of the piston tube 1106. The ring 1114 is thereby fastened in place and fixed in position relative to the piston tube 1106 by the plurality of pins 1116. The thickness 1202 of the ring 1114 may be configured to provide a barrier impeding further extension of the retention spring 1110 along the central axis 1112 without affecting sliding of a rod, e.g., the rod 718 of FIGS. 7-9, within the piston tube 1106 along the central axis 1112. In other words, an inner surface 1208 of the ring 1114 may not contact the rod and is spaced away from the rod. However, the ring 1114 may abut an end of the retention spring 1110. Inner ends 1206 of the plurality of pins 1116 may be either flush with the inner surface 1208 of the ring 1114 or protrude slightly beyond the inner surface 1208 towards the central axis 1112, depending on an amount of clearance between the inner ends 1206 of the plurality of pins 1116 and the rod.

Returning to FIG. 7, the cylinder 702 is shown in the first position 700 where rod 718 is adjusted to the left to a terminal fully retracted position where the head 720 of the rod 718 is in contact with the piston 706. The piston 706 is also adjusted to the left to a fully retracted position where the piston 706 is in contact with the outer housing 704 of the cylinder 702. When in the first position 700, the cylinder 702 may be in a zero stroke condition which may be an initial position when the cylinder is installed during assembly. Compression of the retention spring 736 may be maintained by the retention device 750, as described above. Alternatively, the cylinder 702 may be in the first position 700 when the DWM system is deactivated and the piston 706 and rod 718 are pushed back to the first position 700 for maintenance and/or replacement of DWM system parts. For example, the rod 718 and the piston 706 may be pushed into the first position 700 mechanically, e.g., by a machine, and the retention device 750 inserted to maintain the rod 718 and the piston 706 in the first position 700. Upon completion of maintenance or part replacement, the retention device 750 may be removed and the rod 718 and piston 706 may be adjusted to the second position 800 due to the spring force of the retention spring 736. When the cylinder 702 is in the first position 700, a chain of a DWM mechanism is slack.

The cylinder 702 may reduce slack in the chain of the DWM mechanism during conditions in which the retention device 750 is removed. Once removed, the retention spring 736 is released to expand and press against the spring seat 744. The spring seat 744 is fixed in place, e.g., may not slide to the left due to the fully retracted position of the piston 706 and piston tube 710 which blocks movement of the piston 706 and piston tube 710 to the left. Expansion of the retention spring 736 is thereby manifested at the second end 738 of the retention spring 736 and the second end 738 expands to the right, as indicated by arrows 717. As the second end 738 of the retention spring 736 is fixedly attached to the rod 718, expansion of the retention spring 736 pulls the rod 718 to the right, separating the head 720 of the rod 718 from the piston 706, as shown in a second position 800 of the cylinder 702 depicted in FIG. 8.

When the cylinder 702 is in the second position 800, the piston 706 may be fully retracted into the outer housing 704 of the cylinder 702 but the rod 718 is not fully retracted. Instead, expansion of the retention spring 736 enables biased movement of the rod 718 where the motion of the rod 718 (e.g., to the right) opposes a direction of retraction of the piston (e.g., to the left) by an amount of spring force that maintains a first amount of tension on the chain, holding the chain taut, lower than a second amount of tension imposed on the chain when the DWM mechanism is providing lift. The motion of the rod 718 is biased towards maintaining the DWM mechanism deactivated. While the first amount of tension and the second amount of tension may vary depending on conditions such as air temperature, stiffness of the returning spring 708, a length of the chain, a bouncing of a rail vehicle due to uneven terrain, etc., a passive flexibility of the retention spring 736 may enable inherent accommodation of variation in the first amount of tension. A maximum amount of expansion of the retention spring 736 may be bound by abutting of the foam collar 740 against a rear lip 802 at the second end 734 of the piston tube 710, the rear lip 802 inhibiting protrusion of the foam collar 740 beyond, e.g., to the right of, the second end 734 of the piston tube 710. Thus the retention spring 736 remains compressed in the second position 800 but less compressed than in the first position 700.

Expansion of the retention spring 736 into the second position 800 draws the rod 718 to the right and out of the piston tube 710 by a distance 804 relative to the first position 700. The second end 734 of the piston tube 710 is flush with a rear opening 806 of the outer housing 704 of the cylinder 702, thus the rod 718 also extends further out of the rear opening 806 than in the first position 700 by the distance 804. An expanded length 808 of the retention spring 736 may be greater than the length 707 of the retention spring in the first position 700 by an amount 810 that may be similar to or less than the distance 804. The head 720 of the rod 718 may be spaced away from the front wall 711 of the outer housing 704 of the cylinder 702 by the distance 804.

The cylinder 702 may be adjusted to a third position when lift is requested. The cylinder 702 may be pressurized to a third position 900 as shown in FIG. 9. In the third position 900, the DWM mechanism is activated to provide lift and a pressure in the cylinder 702 is increased, the pressure overcoming the spring force of the returning spring 708 and forcing the piston 706 to slide to the right so that the piston 706 is spaced away from the front wall 711 of the outer housing 704 of the cylinder 702. As the piston 706 slides, the piston comes into contact with the head 720 of the rod 718. The pressure in the cylinder 702 also overcomes the spring force of the retention spring 736, driving the rod 718 to the right and compressing the retention spring 736 against the fixed second end 738 of the retention spring 736 as the spring seat 744 is driven to the right along with the piston tube 710.

The returning spring 708 is also compressed as the piston shifts to the right, decreasing an extension of the returning spring 708 along the central axis 701 to a second length 902 that is shorter than the first length 709 when the cylinder is in the first position 700 and the second position 800. Compression of the returning spring 708 results in the returning spring 708 exerting an increased force, relative to the first position 700 and the second position 800, on the piston 706 along the direction indicated by arrow 760.

A length 904 of the retention spring 736 in the third position 900 may be similar to the length 707 of the retention spring 736 in the first position 700 and less than the length 808 of the retention spring 736 in the second position 800. The shifting of the piston tube 710 to the right decreases an amount that the rod 718 protrudes from the second end 734 of the piston tube 710 compared to the second position 800 and is equal to an amount that the rod 718 protrudes from the second end 734 of the piston tube 710 in the first position 700. In other words, the rod 718 is in a same position relative to the piston tube 710 and piston 706 in the third position 900 as in the first position 700. However, in the third position 900, the piston tube 710 protrudes from the rear opening 806 of the outer housing 704 of the cylinder 702 by a distance 906 whereas the piston tube 710 does not protrude from the rear opening 806 of the outer housing 704 in either the second position 800 or the first position 700.

Adjustment of the cylinder 702 to the third position 900 increases a distance 908 between the head 720 of the rod 718 and the front wall 711 of the outer housing 704 of the cylinder 702 compared to the second position 800 (e.g., the distance 804). When a DWM lift event is terminated and pressure in the cylinder 702 is released, the cylinder 702 may return to the second position 800 as the spring force of the returning spring 708 overcomes the pressure in the cylinder 702 (or lack thereof) and the piston and piston tube 710 are fully retracted in the cylinder 702, partially alleviated compression of the retention spring 736.

The position of the spring seat 744 is fixed once the piston 706 is fully retracted, e.g., the spring seat 744 may not move further to the left, thus expansion of the retention spring 736 is expressed at the second end 738 of the retention spring 736, driving expansion along the direction indicated by arrows 717. The expansion of the retention spring 736 to the right partially offsets the distance that the spring seat 744 travels to the left, pulling the rod 718 along the direction indicated by arrow 717, thereby decreasing the distance the rod 718 slides to the left. As such, the rod 718 is not fully retracted into the cylinder 702.

The stiffness of the retention spring 736, as described above may cause the rod 718 to slide by a smaller amount than the piston 706. Movement of the rod 718 is resisted by the stiffness of the retention spring 736, generating a spring force when compressed that overcomes friction between the piston tube 710 and the rubber ring 726 and between the piston tube 710 and the foam collar 740. For example, the spring force may be 640 lbs. Thus, the retention spring 736 may resist opposing frictional forces so that movement of the rod 718 is suppressed enough to push the rod out of the piston tube 710 by the distance 804, as shown in FIG. 8. The distance 804 may be, in one example, 3 to 5 inches.

As described above, the rod 718 is not fully retracted within the cylinder 702 when the rod 718 protrudes from the second end 734 of the piston tube 710 by the distance 804 relative to when the cylinder 702 is in the first position 700 or the second position 800. In the second position 800 of FIG. 8, the extra protrusion of the rod 718 from the second end 734 of the piston tube 710 compared to the third position 900 of FIG. 9 and the first position 700 of FIG. 7 does not fully alleviate tension on a chain of the DWM mechanism. Instead, a reduced amount of tension, relative to when the cylinder 702 is adjusted to the third position 900 of FIG. 9 during active lifting, maintains the chain taut, decreasing slackness in the chain without shifting weight onto powered axles of a rail vehicle configured with the DWM mechanism.

Figure 14:
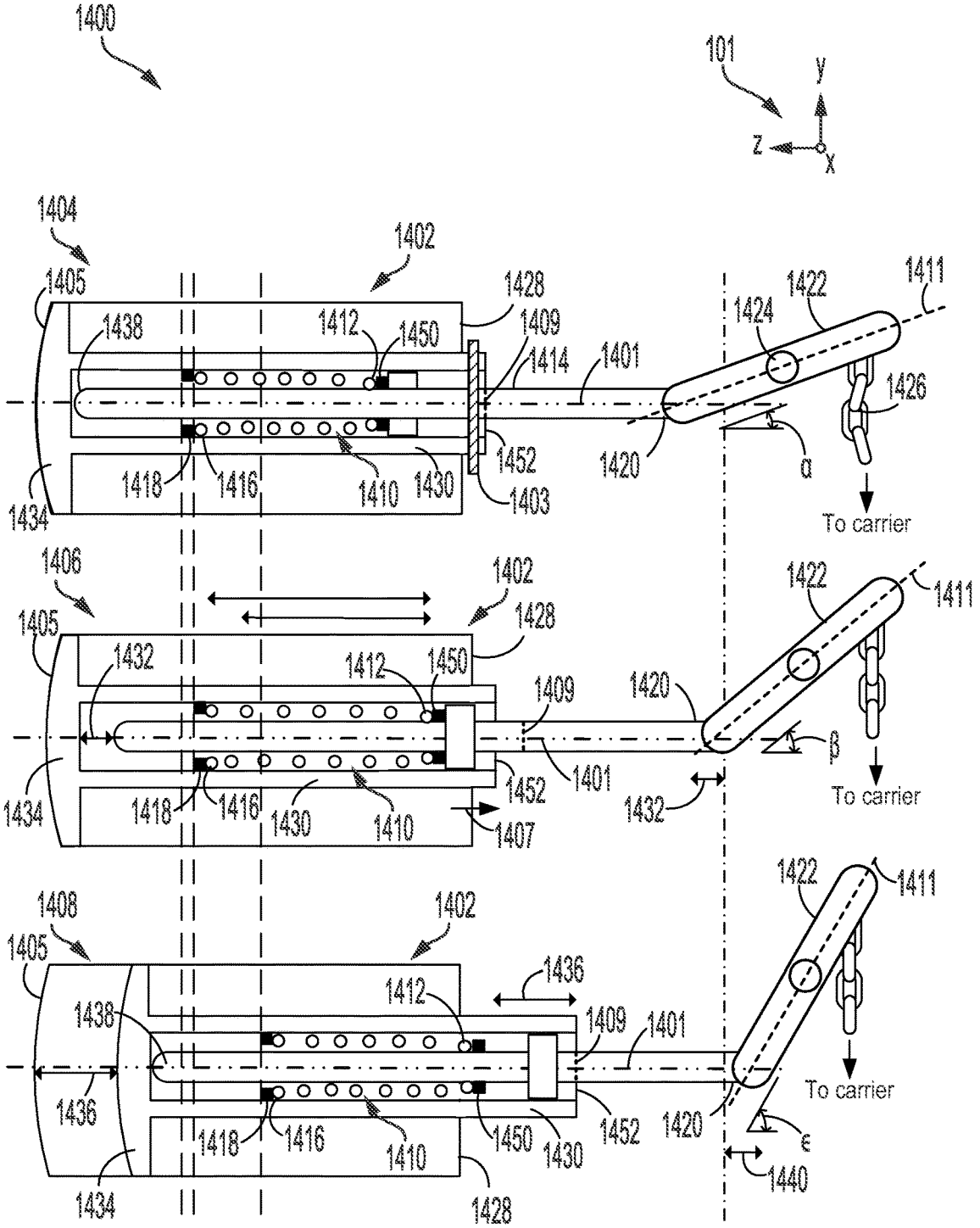
FIG. 14 shows a schematic diagram of a pneumatic actuator arranged in a first, a second, and a third position.

To further illustrate positioning of a pneumatic actuator between the first, second, and third positions 700, 800, and 900 of FIGS. 7-9 respectively, a schematic diagram 1400 is shown in FIG. 14, depicting arrangement of a cylinder 1402 in a first position 1404, a second position 1406, and a third position 1408, the positions similar to the positions shown in FIGS. 7-9. The cylinder 1402 has a central axis 1401 parallel with the z-axis. In the first position 1404, similar to the first position 700 of FIG. 7, a retention spring 1410 may be compressed between a first spring seat 1418 fixedly attached to a piston tube 1430 and a second spring seat 1450 fixedly attached to a rod 1414 by a retention device 1403 which constrains a relative motion between the piston tube 1430 and the rod 1414. The second spring seat 1450 may alternatively be a lip integrated into a surface of the rod 1414, such as the second lip 741 of FIGS. 7-9. The first position 1404 may correspond to an initial position when the cylinder 1402 is installed and at a zero stroke configuration. As described above, a first end 1416 of the retention spring 1410 may be held in place by the first end 1416 of the retention spring 1410 and a first spring seat 1418. A tail end 1420 of the rod 1414 is coupled to a chain crank 1422, configured to pivot about a shaft 1424. In some examples, the chain crank 1422 may be the chain crank 322 of FIGS. 3 and 4. The chain crank 1422 has a longitudinal axis 1411 and is connected to a chain 1426 of the DWM mechanism, extending between a truck frame and a carrier of a rail vehicle and used to distribute weight between axles of the rail vehicle.

In the first position 1404, the chain crank 1422 is at a first angle $\alpha$ that results in the chain 1426 being slack. The first angle $\alpha$ may be an angle between the central axis 1401 of the cylinder 1402 and the longitudinal axis 1411 of the chain crank 1422. In the second position 1406, however, the retention device 1403 may be removed, releasing the movement constraint between the piston tube 1430 and the rod 1414 such that a spring force (e.g., restoring force) of the retention spring 1410 compels expansion of the retention spring 1410. As a result of the expansion of the retention spring 1410, the first end 1416 of the retention spring 1410 pushes against the first spring seat 1418 on the piston tube 1430 and a second end 1412 of the retention spring 1410 pushes against the second spring seat 1450 on the rod 1414. In both of the first position 1404 and second position 1406, movement of the first spring seat 1418 to the left (in the direction opposite to the second end 1412 of the retention spring 1410) is inhibited due to a full retraction of a piston 1434 and a piston tube 1430 into the cylinder 1402. In other words, the piston 1434 is in contact with a front wall 1405 of the cylinder 1402 and may not slide further to the left. As such, the piston tube 1430, fixed to the piston 1434, may not slide further to the left and the first spring seat 1418, fixedly attached to the piston tube 1430 may not slide further to the left. Thus, the retention spring 1410 may not expand to the left due an abutment of the first end 1416 of the retention spring 1410 with the first spring seat 1418. As a result, the retention spring 1410 is forced to expand to the right (e.g., in the direction away from the piston 1434 indicated by arrow 1407), pushing the rod 1414 to the right due to the coupling of the second end 1412 of the retention spring 1410 with the rod 1414 via the second spring seat 1450. A distance that the rod 1414 protrudes from an outer housing 1428 of the cylinder 1402, as well as from a tail end 1452 of the piston tube 1430, increases by a first amount 1432 relative to the first position 1404, also indicated by a shifting of dashed line 1409 to the right in the second position 1406 relative to the first position 1404.

The increase in protrusion of the rod 1414 from the first position 1404 to the second position 1406 rotates the chain crank 1422 counterclockwise to a second angle β which is greater than the first angle α. The second angle β is also an angle between the central axis 1401 of the cylinder 1402 and the longitudinal axis 1411 of the chain crank 1422 and the angle between the two axes (e.g., the second angle β) increases from the first position 1404 to the second position 1406. The rotation of the chain crank 1422 may increase tension on the chain 1426 so that the chain 1426 is tight between the truck frame and carrier without causing a weight transfer across the axles of the rail vehicle. The protrusion of the rod 1414 from the outer housing 1428 of the cylinder 1402 may be further increased when the DWM mechanism is activated and the cylinder 1402 is adjusted to the third position 1408. In the third position 1408, an increase in pressure in the cylinder 1402 drives the piston 1434 and the piston tube 1430 to the right by a second amount 1436.

The second amount 1436 is greater than the first amount 1432, resulting in the rod 1414 sliding further to the right when the piston contacts a head 1438 of the rod 1414. The rod 1414 moves further to the right (e.g., toward the chain crank 1422), relative to the second position 1406, by a third amount 1440. The third amount 1440 may be less than the second amount 1436 and a sum of the first amount 1432 and the third amount 1440 may equal the second amount 1436. While the protrusion of the rod 1414 from the cylinder 1402 increases from the second position 1406 to the third position 1408, the protrusion of the rod 1414 from the piston tube 1430 decreases due to the movement of the piston tube 1430 to the right (e.g., toward the chain crank 1422).

In the third position 1408, the increasing protrusion of the rod 1414 from the cylinder 1402 drives additional counterclockwise rotation of the chain crank 1422, further increasing the angle between the central axis 1401 of the cylinder 1402 and the longitudinal axis 1411 of the chain crank 1422. The chain crank 1422 pivots to a third angle ϵ which is greater than both the first angle α and the second angle β. The rotation of the chain crank 1422 to the third angle ϵ further increases tension on the chain 1426, compelling weight transfer from unpowered axles to powered axles of the rail vehicle. When the DWM mechanism is deactivated and lift is no longer requested, the cylinder 1402 may be depressurized and adjusted to the second position 1406, thereby pivoting the chain crank 1422 in a clockwise (e.g., the direction opposite to the rotation of the chain crank 1422 during adjustment from the second position 1406 to the third position 1408) direction and reducing tension on the chain 1426.

The retention spring 1410 may be configured to maintain a threshold amount of tension on the chain 1426 to mitigate degradation of the chain 1426 and adjacent components of the DWM mechanism when the cylinder 1402 is in the second position 1406. During bouncing of the truck frame, e.g., movement of the truck frame 620 of FIG. 6 along the y-axis, the rod 1414 shown in FIG. 14 may shift along the z-axis, e.g., to the left or right, thereby driving rotation of the chain crank 1422 clockwise or counterclockwise to maintain the threshold amount of tension on the chain 1416.

An example of a routine 1300 for reducing slack in a chain of a DWM mechanism is shown in FIG. 13. The DWM system is implemented in a rail vehicle, such as the locomotive 18 of FIG. 1, travelling along a rail. The chain is coupled to a rotatable crank where rotation of the crank is facilitated by at least one pneumatic actuator, or cylinder, e.g., the cylinder 702 of FIGS. 7-9, coupled to the crank by a rod. The rod extends along a central axis of the cylinder, configured to slide in and out of a housing of the cylinder. A retention spring coils around the rod, extending along a portion of a length of the rod and pressing against a second spring seat on the rod at a second end distal to a head of the rod. A first end of the retention spring abuts and presses against a first spring seat. The first spring seat is configured to resist extension of the spring along the rod, fixedly attached to a piston tube circumferentially surrounding and spaced away from the rod. The head of the rod may be in contact with a cylinder piston, where movement of the piston drives movement of the rod. The cylinder may be pressurized in response to a command from a controller, such as the controller 12 of FIG. 1, to activate the DWM mechanism and transfer weight from unpowered axles to powered axles of the rail vehicle. De-pressurization of the cylinder may be facilitated in response to a command to de-activate the DWM mechanism.

The cylinder may be at a zero stroke position, such as the first position 700 of FIG. 7 where the retention spring is compressed. Alternatively, the cylinder may be at position corresponding to de-activation of the DWM mechanism, such as the second position 800 of FIG. 8. At 1302, the routine includes responding to a command to activate the DWM mechanism to provide lift. Activating the DWM mechanism includes pressurizing the cylinder at 1304. For example, a pressure regulator valve of an actuation system, such as the pneumatic actuation system 502 of FIG. 5, may be opened to communicate pressure from a pressure reservoir to the cylinder. As the cylinder is pressurized, the piston and the rod slide along a first direction within the cylinder, as indicated at 1306. As an example, in the cylinder 702 of FIGS. 7-9, the piston and the rod slide to the right when pressure in the cylinder increases. As the rod moves in the first direction, the crank is rotated to increase tension on the chain, enabling a dynamic weight shift from the non-powered axles to the powered axles of the rail vehicle to increase a tractive force of the rail vehicle on the rail.

At 1308, the method includes responding to a command to deactivate the DWM mechanism and terminate lift. Deactivating the DWM mechanism includes dissipating pressure in the cylinder at 1310. For example, a dump valve of the pneumatic actuation system may be opened to vent pressurized air in the cylinder to the atmosphere. The piston is shifted along a second direction at 1312, opposite of the first direction, by a first amount. The first amount is a distance that the piston travels to along the second direction relative to the positioning of the piston when the DWM mechanism is actively providing lift. For example, in the cylinder 702 of FIG. 7-9, the piston slides to the left. The rod also slides to the left at 1314 by a second amount that is less than the first amount travelled by the piston due to a stiffness of the retention spring. While the piston tube slides to the left along with the piston, a distance between the first spring seat attached to the piston tube and the second spring seat attached to the rod increases and allows the retention spring to expand along the central axis. However, the distance that the rod travels is resisted by a spring force exerted on the first spring seat by the retention spring, forcing the rod to increase a protrusion of the rod out of the piston tube relative to when the rod is fully retracted into the cylinder and piston tube. The increased protrusion of the rod out of the piston tube when the piston tube is fully retracted into the cylinder results in the chain being maintained taut while weight is shifted from the powered axles to the non-powered axles of the rail vehicle.

In this way, degradation of components of a rail vehicle truck, including a DWM mechanism and a linkage arrangement coupled to the DWM mechanism, caused by a slack linkage chain during de-lift operations may be reduced. When fully relaxed, the chain may abrade adjacent parts and surfaces, such as the truck frame, as well as links of the chain itself due to undesirable leeway allowing motion of the chain. Furthermore, rapid changes in chain tension between slack and taut may erode a structural integrity of the chain, leading to frequent maintenance and replacement. By implementing a retention spring in pneumatic actuators of the DWM mechanism, slack in the chain may be reduced. The retention spring may be compressed between a first end abutting a spring seat coupled to a piston tube and a second end in contact with a spring seat fixedly coupled to a piston rod. When the DWM mechanism is deactivated and pressure is dissipated in the pneumatic actuators, the retention spring resists full retraction of the piston rod into the pneumatic actuator, thereby maintaining a decreased tension on the chain, with respect to tension on the chain when providing lift. The slight tension on the chain allows the chain to transition between lift and de-lift operations without experiencing drastic changes in tension. Thus integrity of the truck components is prolonged via a system that does not increase wear of the pneumatic actuation system and operates independent of a speed and operation mode of the rail vehicle.

A technical effect of maintaining a low level of tension on the linkage chain during de-lift operations of the DWM mechanism is that random motion of the chain is reduced and sudden changes in tension on the chain are buffered.

In a first embodiment, a method includes compressing a vehicle suspension by actuating an actuator with a cylinder abutted to a piston rod, the piston rod coupled to the vehicle suspension, and, when deactivating the actuator, maintaining at least nominal compression on the vehicle suspension with the piston rod spaced away from a piston of the cylinder via a biasing member, the piston configured to slide within the cylinder along a central axis of the cylinder. In a first example of the method, deactivating the actuator includes venting a pressure in the actuator to decompress the vehicle suspension until the pressure decreases to a level providing the at least nominal compression on the vehicle suspension, and wherein the actuator is a pneumatic actuator. A second example of the method optionally includes the first examples, and further includes, wherein maintaining the at least nominal compression on the vehicle suspension includes maintaining a device linking the actuator to the vehicle suspension taut without causing a weight transfer at the vehicle axle. A third example of the method optionally includes one or more of the first and second examples, and further includes, wherein maintaining the at least nominal compression on the vehicle suspension when the actuator is deactivated includes spacing the piston rod away from the piston of the cylinder a smaller distance along the central axis than when the actuator is activated. A fourth example of the method optionally includes one or more of the first through third examples, and further includes, wherein maintaining the at least nominal compression on the vehicle suspension includes using a spring force of the biasing member to overcome friction between components of the piston rod in contact with the cylinder and wherein the biasing member is a spring.

In another embodiment, a weight transfer system includes a vehicle suspension coupled to an axle of the vehicle, a pneumatic actuator having a cylinder piston abutted to a piston rod and configured to adjust the vehicle suspension based on a pressure in the pneumatic actuator, the piston rod coupled to the vehicle suspension through a linkage arrangement, and a spring member arranged in the cylinder and configured to exert a force on the piston rod along a central axis of the cylinder in a direction opposing a sliding of the piston rod when the vehicle suspension is decompressed. In a first example of the system, the spring member is wrapped around the piston rod and wherein the spring member and a portion of the piston rod are surrounded by a casing, the casing abutted to the cylinder piston at one end. A second example of the system optionally includes the first example, and further includes, wherein the spring member is configured to be compressed between a first end of the spring member abutting a first spring seat fixedly attached to the piston rod and a second end of the spring member abutting a second spring seat integrated into the casing. A third example of the system optionally includes one or more of the first and second examples, and further includes, wherein the second spring seat comprises a narrowing of an inner diameter of the casing along a portion of a length of the casing that does not surround the spring member, the length parallel with the central axis, and wherein an inner diameter of the second spring seat is narrower than an outer diameter of the spring member. A fourth example of the system optionally includes one or more of the first through third example, and further includes, wherein the second spring seat comprises a ring with a first outer diameter and a first inner diameter, the first outer diameter equal to a second inner diameter of the casing and the first inner diameter narrower than a second outer diameter of the spring member. A fifth example of the system optionally includes one or more of the first through fourth examples, and further includes, wherein when the pneumatic actuator is depressurized to decompress the vehicle suspension, the spring member is less compressed than when the pneumatic actuator is pressurized to compress the vehicle suspension. A sixth example of the system optionally includes one or more of the first through fifth examples, and further includes, wherein the piston rod is in contact with the cylinder piston when the pneumatic actuator is pressurized to compress the vehicle suspension and spaced away from the cylinder piston when the pneumatic actuator is depressurized to decompress the vehicle suspension.

In yet another embodiment, a DWM system includes a lift mechanism including a crank coupled to a chain, the chain extending between a truck and a carrier of the lift mechanism, a pneumatic actuator configured to adjust the lift mechanism by rotating the crank, the pneumatic actuator including a piston coupled to a piston tube, both the piston and the piston tube enclosed by an outer housing of the pneumatic actuator, a rod extending along a central axis of the pneumatic actuator, a first portion of the rod enclosed by the piston tube and a second portion of the rod protruding from the piston tube and coupled to the crank, and a spring enclosed by the piston tube and coiling around the rod, the spring extending between a first end abutting a first spring seat fixedly attached to the rod and a second end abutting a second spring seat fixedly attached to the piston tube. In a first example of the system, the spring has a stiffness that exerts a spring force both on the second spring seat along the central axis of the pneumatic actuator and along a first direction towards a front wall of the outer housing of the pneumatic actuator and on the first spring seat along the central axis of the pneumatic actuator along a second direction, the second direction opposite of the first direction. A second example of the system optionally includes the first example, and further includes wherein the pneumatic actuator is configured to be in a first position when the pneumatic actuator is at ambient pressure and wherein in the first position, the piston contacts the front wall of the outer housing of the pneumatic actuator and the rod is spaced away from the piston by a first distance and protrudes from a rear side of the outer housing of the pneumatic actuator by the first distance. A third example of the system optionally includes one or more of the first and second examples, and further includes, wherein the rod, when moved to protrude from the rear side of the outer housing of the pneumatic actuator by the first distance, is configured to rotate the crank and maintain a first amount of tension on the chain. A fourth example of the system optionally includes one or more of the first through third examples, and further includes, wherein the pneumatic actuator is configured to be in a second position when the pneumatic actuator is at a pressure greater than ambient pressure and wherein in the second position, the piston is spaced away from the front wall of the outer housing of the pneumatic actuator by a second distance that is greater than the first distance and the rod is in contact with the piston and protrudes from the rear side of the outer housing of the pneumatic actuator by the second distance. A fifth example of the system optionally includes one or more of the first through fourth examples, and further includes, wherein the rod, when moved to protrude from the rear side of the outer housing of the pneumatic actuator by the second distance, is configured to increase the rotation of the crank and exert a second amount of tension on the chain, the second amount greater than the first amount of tension and causing a weight transfer event at the lift mechanism. A sixth example of the system optionally includes one or more of the first through fifth examples, and further includes, wherein the pneumatic actuator is configured to return to the first position when the pneumatic actuator is vented from the pressure greater than ambient pressure to ambient pressure and wherein the protrusion of the rod from the rear end of the outer housing of the pneumatic actuator by the first distance is maintained by the spring force of the spring.

In another representation, a method for a dynamic weight transfer (DWT) mechanism, comprising, responsive to a request to activate the DWT mechanism, increasing a pressure in a pneumatic actuator and sliding a piston, a piston tube, and a rod of the pneumatic actuator along a first direction to a first position, the piston tube coupled to the piston and the rod circumferentially surrounded by the piston tube and in contact with the piston at a head of the rod, pivoting a chain crank coupled to the rod along a first rotational direction to a first angle to increase a tension on a chain, the chain attached to the chain crank, to a first amount of tension to facilitate lift, and responsive to a request to deactivate the DWT mechanism, venting the pressure in the pneumatic actuator and sliding the piston and the piston tube along a second direction to a second position, the second direction opposite of the first direction, sliding the rod in the first direction via a spring force of a compressed spring arranged between the rod and the piston tube to drive, the spring force overcoming friction between elements of the rod in contact with the piston tube and partially countering motion of the piston and the piston tube in the second direction, to slide the rod to a position between the first position and the second position, and pivoting the chain crank along a second rotational direction, opposite of the first rotational direction, to a second angle smaller than the first angle to decrease the tension on the chain to a second amount of tension that enables deactivation of the DWM mechanism while maintaining the chain taut. In a first example of the method, sliding the rod to the position between the first position and the second position includes spacing the head of the rod away from the piston of the pneumatic actuator. A second example of the method optionally includes the first method, and further includes, wherein the spring is compressed between a first end of the spring abutting a spring seat fixed to the piston rod and a second end of the spring fixed to the rod. A third example of the method optionally includes one or more of the first and second examples, and further includes, wherein overcoming friction between elements of the rod and the piston tube includes overcoming friction between the piston tube and a rubber ring, the rubber ring encircling the rod the head of the rod and a first retaining lip, and friction between the piston tube and a foam collar surrounding the rod adjacent to the second end of the spring. A fourth example of the method optionally includes one or more of the first through third examples, and further includes, wherein pivoting the chain crank includes varying a protrusion of the rod from an outer housing of the pneumatic actuator.

In yet another representation, a vehicle system comprises a lift mechanism coupled to a truck by a chain extending between a frame of the truck and a carrier of the lift mechanism, and an actuating system configured to adjust the lift mechanism based on a pressure in the actuating system, the actuating system including, a cylinder enclosing a rod coupled at a first end of the rod to the lift mechanism and a spring, the spring including a first end abutting a first spring seat fixedly attached to the rod and a second end abutting a second spring seat fixedly attached to a piston tube circumferentially surrounding the rod, the second end opposite of the first end. In a first example of the system, the spring extends along a portion of a length of the rod, the length parallel with a central axis of the cylinder and the portion of the length of the rod enclosed by an outer housing of the cylinder and wherein the spring is arranged in a space between the rod and the piston tube, the piston tube spaced away from the rod and the spring also extending along a portion of a length of the piston tube. A second example of the system optionally includes the first example, and further includes, wherein the actuating system further includes a piston housed in the cylinder, wherein the first end of the rod extends out of the outer housing of the cylinder by a first amount when the rod and the piston are fully retracted into the cylinder in a first position, the rod including a second end that is configured to contact the piston in the first position. A third example of the system optionally includes one or more of the first and second examples, and further includes, wherein the first end of the rod extends out of the outer housing of the cylinder by a second amount that is greater than the first amount when the cylinder is adjusted to a third position where the spring is less compressed than in the first position and the piston and the piston tube are fully retracted into the cylinder. A fourth example of the system optionally includes one or more of the first through third examples, and further includes, wherein the first end of the rod extends out of the outer housing of the cylinder by a third amount that is greater than the second amount when the cylinder is pressurized to a third position and the piston, the piston tube, and the rod are shifted away from a front wall of the outer housing by a distance equal to the third amount. A fifth example of the system optionally includes one or more of the first through fourth examples, and further includes, wherein the first end of the rod extends beyond a second end of the piston tube, the second end opposite of the first end, by a greater amount when the cylinder is in the second position than when the cylinder is in the third position.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for weight transfer of a vehicle axle, comprising:

compressing a vehicle suspension by actuating a pneumatic actuator comprising an outer housing with a cylinder abutted to a piston rod coupled to the vehicle suspension;

adjusting a position of the pneumatic actuator to a first position;

wherein, in the first position, a piston contacts a front wall of the outer housing of the pneumatic actuator and the piston rod is spaced away from the piston by a first distance and protrudes from a rear side of the outer housing of the pneumatic actuator by the first distance;

deactivating the pneumatic actuator; and when deactivating the pneumatic actuator, maintaining at least nominal compression on the vehicle suspension with the piston rod spaced away from the piston of the cylinder via a biasing member, the piston configured to slide within the cylinder along a central axis of the cylinder.

2. The method of claim 1, wherein deactivating the pneumatic actuator includes venting the pressure in the pneumatic actuator to decompress the vehicle suspension until the pressure decreases to a level providing the at least nominal compression on the vehicle suspension.

3. The method of claim 1, wherein maintaining the at least nominal compression on the vehicle suspension includes maintaining a device linking the pneumatic actuator to the vehicle suspension taut without causing the weight transfer at the vehicle axle.

4. The method of claim 1, wherein maintaining the at least nominal compression on the vehicle suspension when the pneumatic actuator is deactivated includes spacing the piston rod away from the piston of the cylinder a smaller distance along the central axis than when the pneumatic actuator is activated.

5. The method of claim 1, wherein maintaining the at least nominal compression on the vehicle suspension includes using a spring force of the biasing member to overcome friction between components of the piston rod in contact with the cylinder and wherein the biasing member is a spring.

6. A weight transfer system for a vehicle, comprising;

a vehicle suspension coupled to an axle of the vehicle;

a pneumatic actuator comprising an outer housing having a cylinder piston abutted to a piston rod and configured to adjust the vehicle suspension based on a pressure in the pneumatic actuator, the piston rod coupled to the vehicle suspension through a linkage arrangement; and a spring member arranged in the cylinder piston and configured to exert a force on the piston rod along a central axis of the cylinder piston in a direction opposing a sliding of the piston rod when the vehicle suspension is decompressed;

wherein the piston rod is in contact with the cylinder piston when the pneumatic actuator is pressurized to compress the vehicle suspension and at ambient pressure, the cylinder piston is in contact with a front wall of the outer housing of the pneumatic actuator and the piston rod is spaced away from the cylinder piston by a first distance and protrudes from a rear side of the outer housing of the pneumatic actuator by the first distance.

7. The weight transfer system of claim 6, wherein the spring member is wrapped around the piston rod and wherein the spring member and a portion of the piston rod are surrounded by a casing, the casing abutted to the cylinder piston at one end.

8. The weight transfer system of claim 7, wherein the spring member is configured to be compressed between a first end of the spring member abutting a first spring seat fixedly attached to the piston rod and a second end of the spring member abutting a second spring seat integrated into the casing.

9. The weight transfer system of claim 8, wherein the second spring seat comprises a narrowing of an inner diameter of the casing along a portion of a length of the casing that does not surround the spring member, the length parallel with the central axis, and wherein an inner diameter of the second spring seat is narrower than an outer diameter of the spring member.

10. The weight transfer system of claim 8, wherein the second spring seat comprises a ring with a first outer diameter and a first inner diameter, the first outer diameter equal to a second inner diameter of the casing and the first inner diameter narrower than a second outer diameter of the spring member.

11. The weight transfer system of claim 6, wherein when the pneumatic actuator is depressurized to decompress the vehicle suspension, the spring member is less compressed than when the pneumatic actuator is pressurized to compress the vehicle suspension.

12. The weight transfer system of claim 6, wherein a nominal amount of compression is maintained on the vehicle suspension by the force exerted on the piston rod by the spring member when the pneumatic actuator is depressurized.

13. A vehicle suspension system, comprising:

a lift mechanism including a crank coupled to a chain, the chain extending between a truck and a carrier of the lift mechanism; and a pneumatic actuator configured to adjust the lift mechanism by rotating the crank, the pneumatic actuator including:

a piston coupled to a piston tube, both the piston and the piston tube enclosed by an outer housing of the pneumatic actuator;

a rod extending along a central axis of the pneumatic actuator, a first portion of the rod enclosed by the piston tube and a second portion of the rod protruding from the piston tube and coupled to the crank; and a spring enclosed by the piston tube and coiling around the rod, the spring extending between a first end abutting a first spring seat fixedly attached to the rod and a second end abutting a second spring seat fixedly attached to the piston tube;

wherein the pneumatic actuator is configured to be in a first position when the pneumatic actuator is at ambient pressure and wherein in the first position, the piston contacts a front wall of the outer housing of the pneumatic actuator and the rod is spaced away from the piston by a first distance and protrudes from a rear side of the outer housing of the pneumatic actuator by the first distance.

14. The system of claim 13, wherein the spring has a stiffness that exerts a spring force both on the second spring seat along the central axis of the pneumatic actuator and along a first direction towards the front wall of the outer housing of the pneumatic actuator and on the first spring seat along the central axis of the pneumatic actuator along a second direction, the second direction opposite of the first direction.

15. The system of claim 13, wherein the rod, when moved to protrude from the rear side of the outer housing of the pneumatic actuator by the first distance, is configured to rotate the crank and maintain a first amount of tension on the chain.

16. The system of claim 15, wherein the pneumatic actuator is configured to be in a second position when the pneumatic actuator is at a pressure greater than ambient pressure and wherein in the second position, the piston is spaced away from the front wall of the outer housing of the pneumatic actuator by a second distance that is greater than the first distance and the rod is in contact with the piston and protrudes from the rear side of the outer housing of the pneumatic actuator by the second distance.

17. The system of claim 16, wherein the rod, when moved to protrude from the rear side of the outer housing of the pneumatic actuator by the second distance, is configured to increase the rotation of the crank and exert a second amount of tension on the chain, the second amount greater than the first amount of tension and causing a weight transfer at the lift mechanism.

18. The system of claim 17, wherein the pneumatic actuator is configured to return to the first position when the pneumatic actuator is vented from the pressure greater than ambient pressure to ambient pressure and wherein the protrusion of the rod from the rear end of the outer housing of the pneumatic actuator by the first distance is maintained by the spring force of the spring.

* * * * *